US009679474B2

(12) United States Patent
Kaminade et al.

(10) Patent No.: US 9,679,474 B2
(45) Date of Patent: Jun. 13, 2017

(54) OTHER-VEHICLE DETECTION APPARATUS, DRIVING ASSISTANCE APPARATUS, AND OTHER-VEHICLE DETECTION METHOD

(71) Applicants: Takuya Kaminade, Susono (JP); Shinya Kawamata, Mishima (JP); Osamu Ozaki, Mishima (JP)

(72) Inventors: Takuya Kaminade, Susono (JP); Shinya Kawamata, Mishima (JP); Osamu Ozaki, Mishima (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 90 days.

(21) Appl. No.: 14/433,797

(22) PCT Filed: Nov. 6, 2012

(86) PCT No.: PCT/JP2012/078709

§ 371 (c)(1),
(2) Date: Apr. 6, 2015

(87) PCT Pub. No.: WO2014/073033

PCT Pub. Date: May 15, 2014

(65) Prior Publication Data

US 2015/0235554 A1 Aug. 20, 2015

(51) Int. Cl.
*G08G 1/04* (2006.01)
*G08G 1/01* (2006.01)

(52) U.S. Cl.
CPC ..... *G08G 1/01* (2013.01)

(58) Field of Classification Search
None
See application file for complete search history.

(56) References Cited

U.S. PATENT DOCUMENTS 5,654,715 A * 8/1997 Hayashikura ..... G01S 13/931 342/70
6,326,915 B1 * 12/2001 Chen ..... G01S 7/06 342/118
2012/0092185 A1 * 4/2012 Hayashi ..... B60Q 5/008 340/904
2012/0299717 A1 * 11/2012 Yoshino ..... B60Q 9/00 340/466
2013/0214918 A1 * 8/2013 Schumann ..... G01S 13/48 340/435

FOREIGN PATENT DOCUMENTS

JP 5-92767 U 12/1993
JP 2012-35822 A 2/2012
JP 2012-38136 A 2/2012

* cited by examiner

*Primary Examiner* — Julie Lieu
(74) *Attorney, Agent, or Firm* — Sughrue Mion, PLLC

(57) ABSTRACT

An other-vehicle detection apparatus includes: a sound source device mounted on a first vehicle and configured to output a non-audible region sound of a predetermined frequency range set in advance; a sound collection device mounted on the first vehicle and configured to collect sound information around the first vehicle; and a distinction device configured to distinguish a second vehicle based on a non-audible region sound included in the sound information collected by the sound collection device of the first vehicle.

6 Claims, 14 Drawing Sheets

OTHER-VEHICLE DETECTION APPARATUS, DRIVING ASSISTANCE APPARATUS, AND OTHER-VEHICLE DETECTION METHOD

CROSS REFERENCE TO RELATED APPLICATIONS

This application is a National Stage of International Application No. PCT/JP2012/078709 filed Nov. 6, 2012, the contents of all of which are incorporated herein by reference in their entirety.

FIELD

The present invention relates to an other-vehicle detection apparatus, a driving assistance apparatus, and an other-vehicle detection method.

BACKGROUND

As an other-vehicle detection apparatus mounted on a vehicle, a driving assistance apparatus, and an other-vehicle detection method of the related art, for example, Patent Literature 1 discloses an approaching vehicle recognition device which detects the orientation of an approaching vehicle with respect to an own vehicle. The approaching vehicle recognition device detects the traveling sound of the other vehicle by a plurality of acoustic-electric converters disposed at a predetermined interval and determines the incoming direction of the traveling sound of the approaching vehicle by applying various processes to an acoustic signal corresponding to the traveling sound.

CITATION LIST

Patent Literature

Patent Literature 1: Japanese Patent Application Laid-open No. 5-92767

SUMMARY

Technical Problem

Incidentally, the approaching vehicle recognition device disclosed in Patent Literature 1 needs to appropriately distinguish and handle the other vehicle, for example, even when the traveling sound is small or the environment noise is large.

The invention is made in view of the above-described circumstances, and an object thereof is to provide an other-vehicle detection apparatus, a driving assistance apparatus, and an other-vehicle detection method capable of appropriately distinguishing and handling the other vehicle.

Solution to Problem

To achieve the above-described object, an other-vehicle detection apparatus according to the present invention includes: a sound source device mounted on a vehicle and configured to output a non-audible region sound of a predetermined frequency range set in advance; a sound collection device mounted on the vehicle and configured to collect sound information around the vehicle; and a distinction device configured to distinguish the second vehicle based on a non-audible region sound included in the sound information collected by the sound collection device of the first vehicle.

Moreover, in the above-described other-vehicle detection apparatus, the distinction device distinguishes the second vehicle approaching the first vehicle based on a difference between a frequency of the non-audible region sound included in the sound information collected by the sound collection device of the first vehicle and a frequency of a non-audible region sound output from the sound source device of the second vehicle.

Moreover, in the above-described other-vehicle detection apparatus, at a time a frequency of the non-audible region sound output from the sound source device of the first vehicle is same as a frequency of a non-audible region sound output from the sound source device of the second vehicle, the distinction device distinguishes between the first vehicle and the second vehicle, which is traveling, based on a difference between the frequency of the non-audible region sound included in the sound information collected by the sound collection device of the first vehicle and the frequencies of the non-audible region sounds output from the sound source devices of the first vehicle and the second vehicle.

Moreover, the above-described other-vehicle detection apparatus includes a vehicle state detection device configured to detect a state of the vehicle, and the sound source device outputs a non-audible region sound including information relating to the state of the vehicle detected by the vehicle state detection device and corresponding to the non-audible region sound of the predetermined frequency range.

To achieve the above-described object, a driving assistance apparatus according to the present invention includes: a sound source device mounted on a vehicle and configured to output a non-audible region sound of a predetermined frequency range set in advance; a sound collection device mounted on the vehicle and configured to collect sound information around the vehicle; a distinction device configured to distinguish the second vehicle based on a non-audible region sound included in the sound information collected by the sound collection device of the first vehicle; an assistance device mounted on the vehicle and configured to assist a driving operation in the vehicle; and a control device configured to assist the driving operation by controlling the assistance device of the first vehicle at a time the distinction device distinguishes the second vehicle.

Moreover, in the above-described driving assistance apparatus, the control device changes a driving assistance content of the assistance device in the first vehicle in accordance with information relating to the second vehicle based on the non-audible region sound included in the sound information collected by the sound collection device of the first vehicle.

Moreover, in the above-described driving assistance apparatus, the control device calculates a vehicle speed of the second vehicle based on a difference between a frequency of the non-audible region sound included in the sound information collected by the sound collection device of the first vehicle and a frequency of the non-audible region sound output from the sound source device of the second vehicle as the information relating to the second vehicle, and changes a driving assistance content of the assistance device in the first vehicle based on the calculated vehicle speed of the second vehicle.

Moreover, the above-described driving assistance apparatus includes a vehicle state detection device configured to detect a state of the vehicle, the sound source device outputs a non-audible region sound including information relating to the state of the vehicle detected by the vehicle state detection device and corresponding to the non-audible region sound of the predetermined frequency range, and the control device changes a driving assistance content of the assistance device in the first vehicle in accordance with information relating to a state of the second vehicle obtained by analyzing the sound information collected by the sound collection device of the first vehicle.

To achieve the above-described object, an other-vehicle detection method according to the present invention is performed by using: a sound source device mounted on a vehicle and configured to output a non-audible region sound of a predetermined frequency range set in advance; and a sound collection device mounted on the vehicle and configured to collect sound information around the vehicle, and includes distinguishing a second vehicle based on a non-audible region sound included in the sound information collected by the sound collection device of a first vehicle.

Advantageous Effects of Invention

There is an effect that the other vehicle may be appropriately distinguished and handled by the other-vehicle detection apparatus, the driving assistance apparatus, and the other-vehicle detection method according to the invention.

DESCRIPTION OF EMBODIMENTS

Hereinafter, embodiments according to the invention will be described in detail with reference to the drawings. In addition, the invention is not limited to the embodiments. Further, the components in the embodiments below include a component which may be easily replaced by the person skilled in the art or a component which has substantially the same configuration.

First Embodiment

Figure 1:
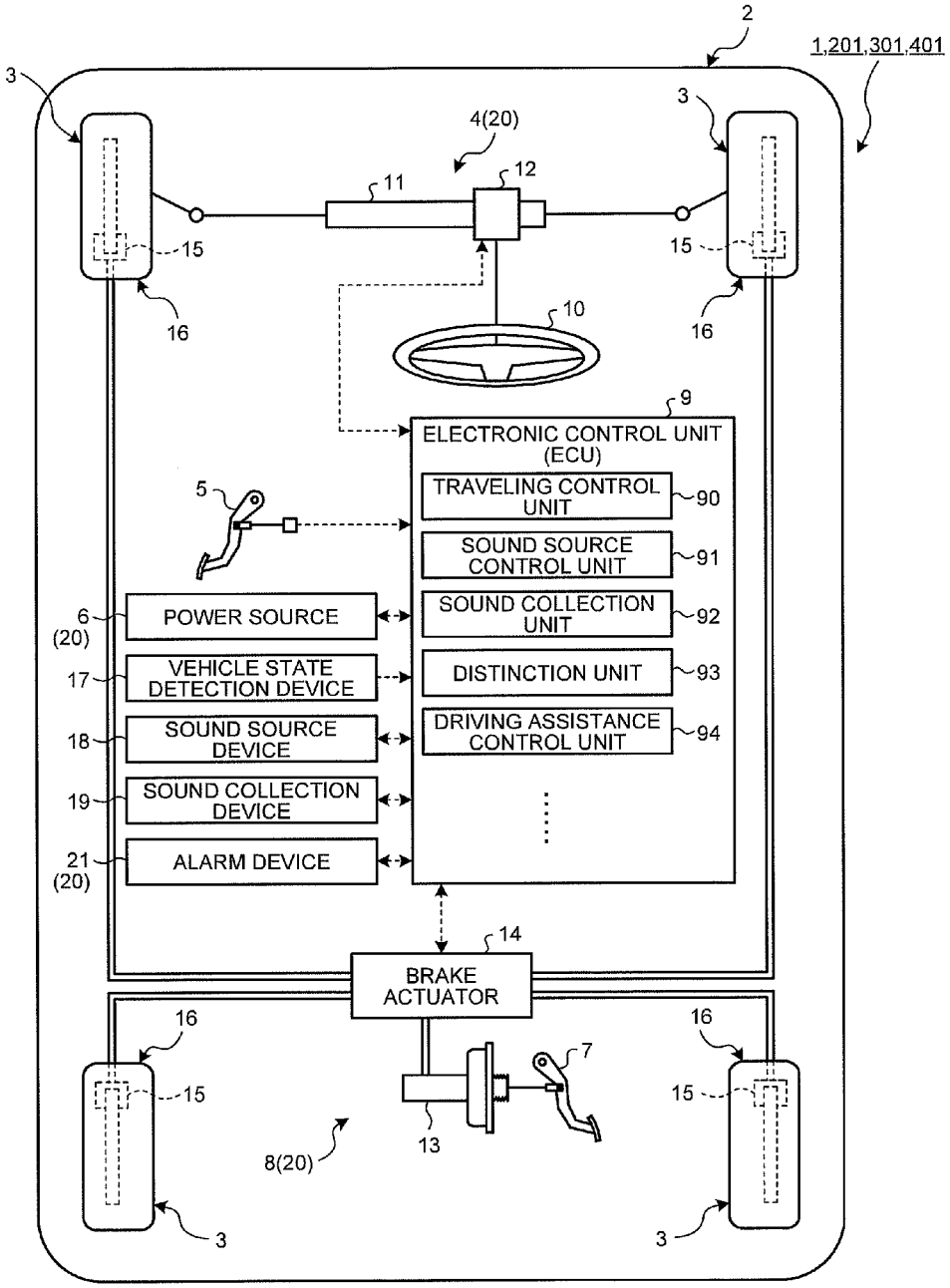
FIG. 1 is a schematic configuration diagram illustrating a vehicle that employs a driving assistance apparatus according to a first embodiment.
Figure 2:
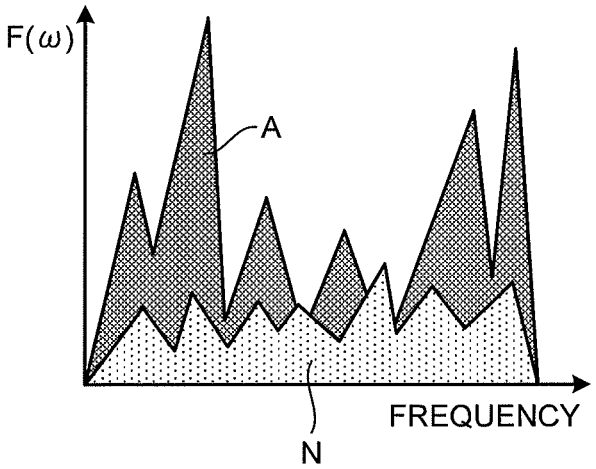
FIG. 2 is a line map illustrating an example of an environment noise element and a traveling sound of a conventional vehicle.
Figure 3:
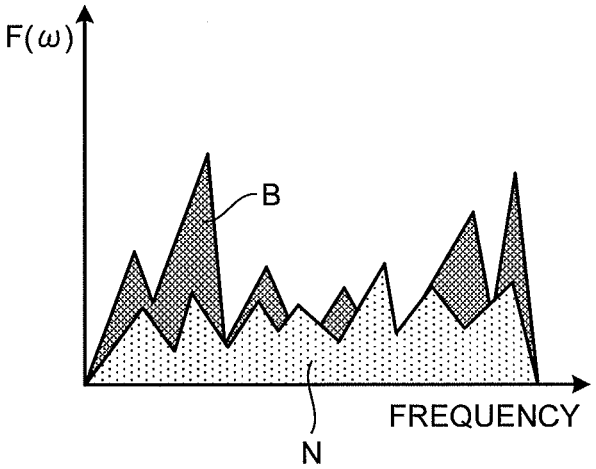
FIG. 3 is a line map illustrating an example of an environment noise element and a traveling sound in each of an HV vehicle and an EV vehicle.
Figure 4:
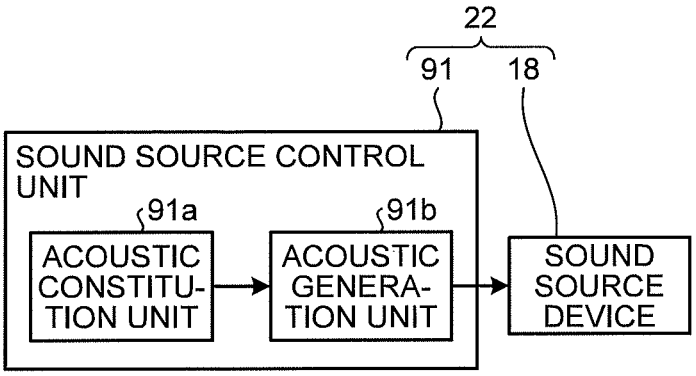
FIG. 4 is a block diagram illustrating a schematic configuration example of an acoustic generator of a driving assistance apparatus according to the first embodiment.
Figure 5:
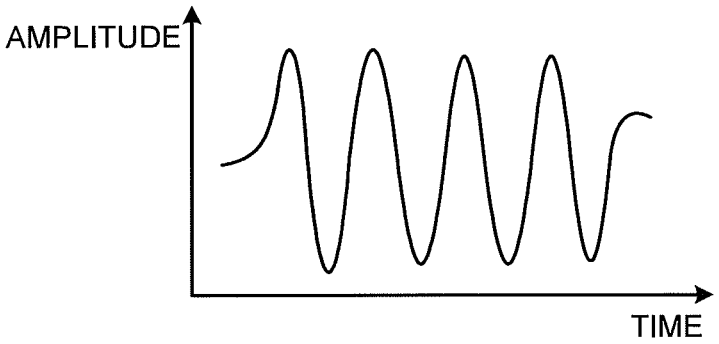
FIG. 5 is a line map illustrating an example of a waveform of a non-audible region sound which is generated by the acoustic generator of the driving assistance apparatus according to the first embodiment.
Figure 6:
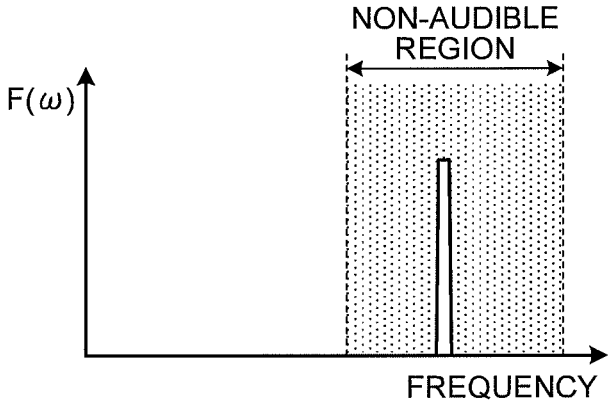
FIG. 6 is a line map illustrating an example of a frequency of the non-audible region sound which is generated by the acoustic generator of the driving assistance apparatus according to the first embodiment.
Figure 7:
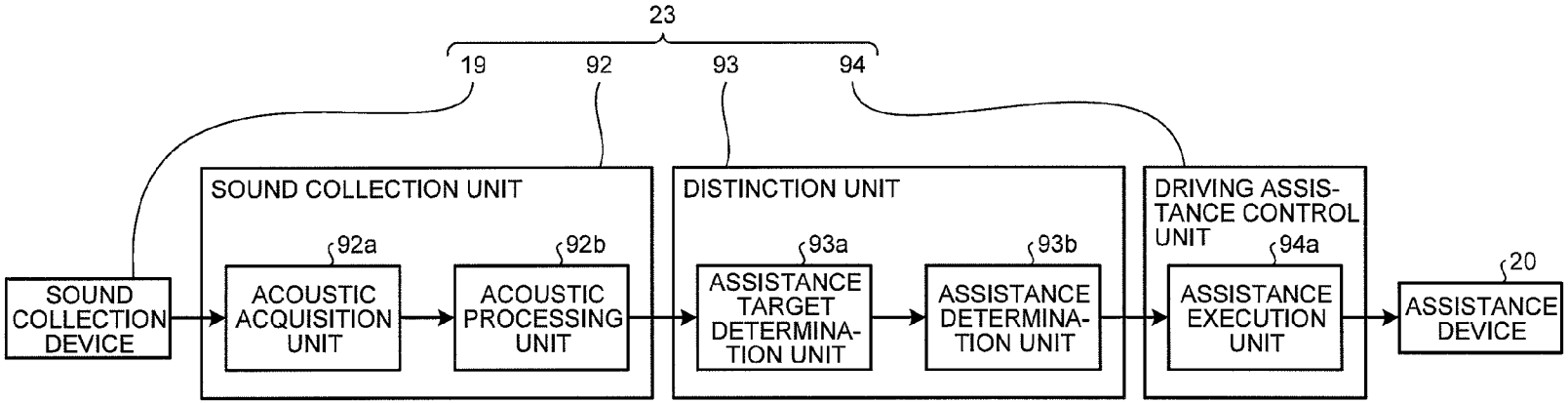
FIG. 7 is a block diagram illustrating a schematic configuration example of an acoustic receiver of the driving assistance apparatus according to the first embodiment.
Figure 8:
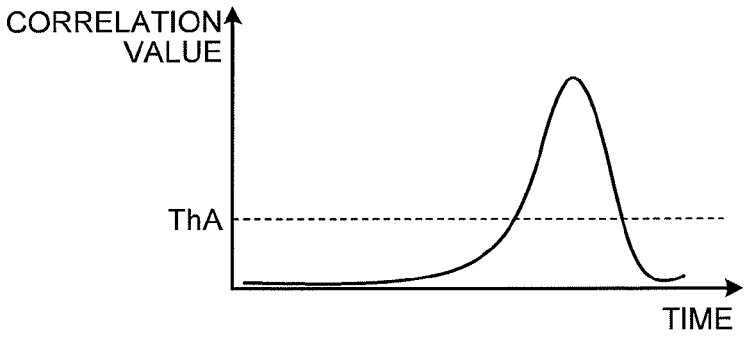
FIG. 8 is a line map illustrating an example of a correlation value of the driving assistance apparatus according to the first embodiment.
Figure 9:
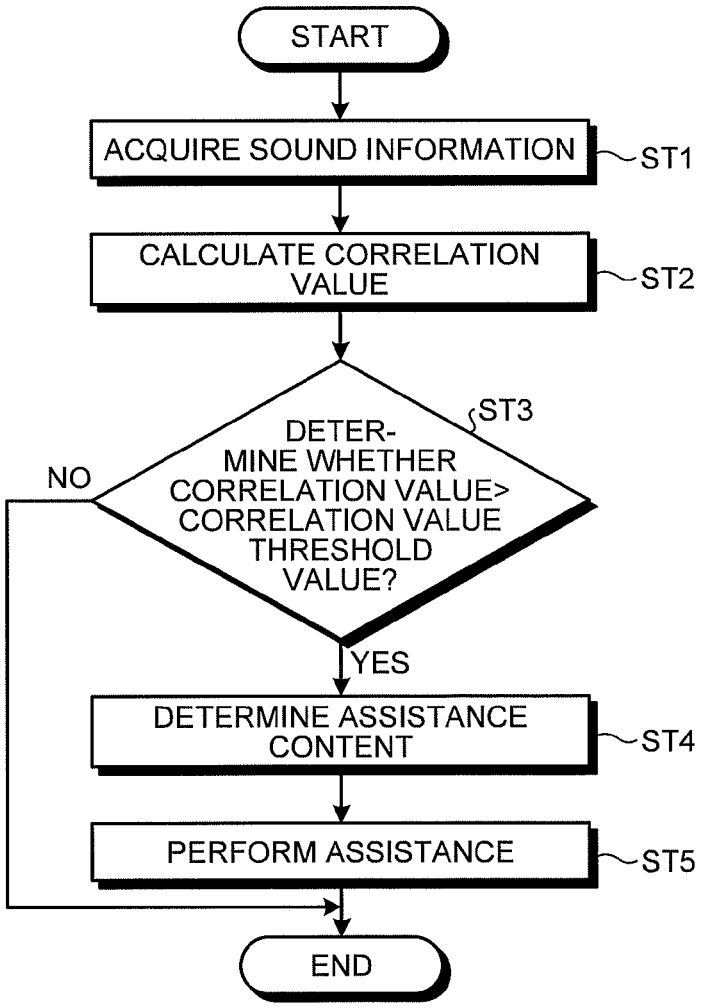
FIG. 9 is a flowchart illustrating an example of a control that is performed by an ECU of the driving assistance apparatus according to the first embodiment.

FIG. 1 is a schematic configuration diagram illustrating a vehicle that employs a driving assistance apparatus according to a first embodiment. FIG. 2 is a line map illustrating an example of an environment noise element and a traveling sound of a conventional vehicle. FIG. 3 is a line map illustrating an example of an environment noise element and a traveling sound of an HV vehicle and an EV vehicle. FIG. 4 is a block diagram illustrating a schematic configuration example of an acoustic generator of a driving assistance apparatus according to a first embodiment. FIG. 5 is a line map illustrating an example of a waveform of a non-audible region sound which is generated by the acoustic generator of the driving assistance apparatus according to the first embodiment. FIG. 6 is a line map illustrating an example of a frequency of the non-audible region sound which is generated by the acoustic generator of the driving assistance apparatus according to the first embodiment. FIG. 7 is a block diagram illustrating a schematic configuration example of an acoustic receiver of the driving assistance apparatus according to the first embodiment. FIG. 8 is a line map illustrating an example of a correlation value of the driving assistance apparatus according to the first embodiment. FIG. 9 is a flowchart illustrating an example of a control that is performed by an ECU of the driving assistance apparatus according to the first embodiment.

As illustrated in FIG. 1, a driving assistance apparatus 1 according to the embodiment is mounted on a vehicle 2. Typically, the driving assistance apparatus 1 is a system that suppresses a head-to-head contact and serves as the other-vehicle detection apparatus so that various driving assistance operations are performed by recognizing the other vehicle around the own vehicle. That is, here, the driving assistance apparatus 1 may be a device that performs a driving assistance operation while serving as the other-vehicle detection apparatus. Further, the invention is not limited thereto, and the other-vehicle detection apparatus may be separated from the driving assistance apparatus 1. The driving assistance apparatus 1 of the embodiment generates a non-audible region sound by, for example, a sound source device 18 and notifies the existence of the own vehicle to the other vehicle or detects the existence of the other vehicle around the own vehicle. Accordingly, the driving assistance apparatus 1 may detect not only the other vehicle which may be directly and visually recognized by the driver, but also the other vehicle which exists in an area of a blind angle for the own vehicle or the driver. Further, the driving assistance apparatus 1 may provide the traveling state information for the own vehicle by, for example, an acoustic modulation technique as a further improvement in performance. The driving assistance apparatus 1 is realized in a manner such that the components illustrated in FIG. 1 are mounted on the vehicle 2. The components illustrated in FIG. 1 are commonly mounted on the own vehicle as the first vehicle 2 and the other vehicle as the second vehicle 2 around the own vehicle.

Specifically, the driving assistance apparatus 1 is mounted on the vehicle 2 equipped with a vehicle wheel 3, and includes a steering device 4, an accelerator pedal 5, a power source 6, a brake pedal 7, a braking device 8, an electronic control unit (hereinafter, also referred to as an "ECU") 9, and the like. In the vehicle 2, the power source 6 generates a power (a torque) in accordance with the operation of the accelerator pedal 5 from a driver, and the power is transmitted to the vehicle wheel 3 through a power transmission device (not illustrated), so that a driving force is generated in the vehicle wheel 3. Further, the vehicle 2 generates a braking force in the vehicle wheel 3 in a manner such that the braking device 8 is operated in accordance with the operation of the brake pedal 7 from the driver.

The steering device 4 steers the right and left front wheels of four vehicle wheels 3 as steered wheels. The steering device 4 includes a steering wheel 10 which corresponds to a steering operation member operated by the driver and a steering angle giving mechanism 11 which is driven in accordance with the steering operation of the steering wheel 10. As the steering angle giving mechanism 11, for example, a so-called rack and pinion mechanism including a rack gear and a pinion gear may be used, but the invention is not limited thereto. Further, the steering device 4 includes an EPS device 12. The EPS device 12 may steer the steered wheels by a predetermined steering amount in accordance with the steering torque as the steering force input from the driver to the steering wheel 10 as the steering member. The EPS device 12 assists the driver's steering operation by generating an assist torque for assisting the operation of the steering wheel 10 of the driver by the power of an electric motor or the like.

The power source 6 is a traveling power source for an internal-combustion engine or an electric motor. The vehicle 2 may be any vehicle such as an HV (hybrid) vehicle which includes both an internal-combustion engine and an electric motor as a traveling power source, a conventional vehicle which includes only an internal-combustion engine and does not include an electric motor, and an EV (electric) vehicle which includes only an electric motor and does not include an internal-combustion engine.

The braking device 8 may individually adjust the braking force generated in each vehicle wheel 3 of the vehicle 2. The braking device 8 corresponds to various hydraulic brake devices in which brake oil such as a working fluid is charged in a hydraulic line connected from a master cylinder 13 to a wheel cylinder 15 through a brake actuator 14. The braking device 8 generates a pressure braking force in the vehicle wheel 3 by operating a hydraulic braking unit 16 in accordance with the braking pressure supplied to the wheel cylinder 15. When the driver operates the brake pedal 7 in the braking device 8, a master cylinder pressure (an operation pressure) is applied to the brake oil by the master cylinder 13 in accordance with the pedal stepping force (the operation force) acting on the brake pedal 7. Then, the hydraulic braking unit 16 in the braking device 8 is operated in a manner such that a pressure generated in accordance with the master cylinder pressure is applied to each wheel cylinder 15 as a wheel cylinder pressure (a braking pressure). In each hydraulic braking unit 16, a brake pad is pressed against a disk rotor, so that a predetermined rotation resisting force generated in accordance with the wheel cylinder pressure is applied to the disk rotor rotating along with the vehicle wheel 3. Accordingly, a braking force may be applied to the disk rotor and the vehicle wheel 3 rotating along with the disk rotor. In the meantime, the wheel cylinder pressure is appropriately adjusted in accordance with the driving state by the brake actuator 14 of the braking device 8. The brake actuator 14 individually adjusts the braking force generated in each vehicle wheel 3 by individually increasing, decreasing, and maintaining the wheel cylinder pressure of each of four wheels.

The ECU 9 controls the driving of the units of the vehicle 2, and includes an electronic circuit mainly including an existing microcomputer with a CPU, a ROM, a RAM, and an interface. The ECU 9 is electrically connected to, for example, various sensors and detectors, and receives electric signals generated in accordance with the detection result. Further, the ECU 9 is electrically connected to the units of the vehicle 2 like the EPS device 12 of the steering device 4, the power source 6, and the brake actuator 14 of the braking device 8, and outputs a driving signal thereto. The ECU 9 outputs drive signals to the units of the vehicle 2 like the EPS device 12 of the steering device 4, the power source 6, and the brake actuator 14 of the braking device 8 and controls the driving of the units by performing a control program stored therein based on various maps or various input signals input from various sensors and detectors.

For example, the driving assistance apparatus 1 of the embodiment includes a vehicle state detection device 17 which detects the state of the vehicle 2 equipped with the driving assistance apparatus 1 as various sensors and detectors. The vehicle state detection device 17 may include, for example, at least one of a vehicle speed sensor, a yaw rate sensor, a rudder angle sensor, an acceleration sensor, an image capturing device, and a GPS receiver. The vehicle speed sensor detects the vehicle speed of the vehicle 2. The yaw rate sensor detects the yaw rate of the vehicle 2. The rudder angle sensor detects the rudder angle of the vehicle 2. The acceleration sensor detects the acceleration generated in the vehicle body of the vehicle 2. The image capturing device may be configured as, for example, a CCD camera or the like, and captures the image of the front area of the vehicle 2 in the traveling direction. The GPS receiver receives the GPS information (coordinate) of the vehicle 2. The ECU 9 may calculate the traveling direction or the traveling point (the current position) of the vehicle 2 based on, for example, map information such as road information stored in a database and GPS information received by the GPS receiver. Further, the vehicle state detection device 17 may include, for example, a vehicle-to-vehicle communication unit or a road-to-vehicle communication unit.

Incidentally, when the ECU 9 assists the driving operation so that the head-to-head contact may be suppressed, it is desirable to distinguish the other vehicle around the own vehicle with high precision. Here, for example, in the device which detects the other vehicle approaching the own vehicle by using the traveling sound of the vehicle 2, there is a room for improvement in that the distinction precision for the other vehicle needs to be improved when the traveling sound of the vehicle 2 is small or the environment noise is large. For example, there is a tendency that the engine sound or the wind sound is relatively small when the approaching vehicle is the HV vehicle or the EV vehicle. FIGS. 2 and 3 illustrate an example of a relation between the traveling sound and the environment noise element. As illustrated in FIGS. 2 and 3, there is a tendency that the traveling sound B of the EV vehicle or the HV vehicle is buried in the noise element N of the environment sound compared to the traveling sound A of the conventional vehicle. For this reason, there is a concern that the approaching vehicle recognition rate may be low in the configuration in which the other vehicle is detected by the traveling sound. The same applies to the case of the vehicle 2 to which a tire having a small traveling sound is attached.

Therefore, since the driving assistance apparatus 1 of the embodiment actively generates a non-audible region sound and distinguishes the other vehicle around the own vehicle by using the non-audible region sound, the other vehicle may be appropriately distinguished. Accordingly, the driving assistance apparatus 1 may more appropriately assist the driving operation.

Specifically, as illustrated in FIG. 1, the driving assistance apparatus 1 includes the sound source device 18, a sound collection device 19, and an assistance device 20, and the ECU 9 serves as the distinction device and the control device of the driving assistance apparatus 1.

The sound source device 18 is mounted on each vehicle 2 and may output a non-audible region sound of a predetermined frequency range set in advance. Here, each vehicle 2 is a vehicle that enjoys the driving assistance operation of the system that suppresses the head-to-head contact. The sound source device 18 is provided separately from a sound source like the power source 6, and may be configured as, for example, a speaker or the like. Typically, the predetermined frequency range is set in a frequency range which corresponds to a non-audible region of a human or an animal and a frequency range in which a sound may be collected by the sound collection device 19 to be described later. The predetermined frequency range is set in a region of, for example, 20 kHz to 100 kHz. The sound source device 18 of the embodiment may output a non-audible region sound of a predetermined frequency in the predetermined frequency range. The sound source device 18 is electrically connected to the ECU 9, and is controlled by the ECU 9.

The sound collection device 19 is mounted on each vehicle 2 and may collect sound information around the vehicle 2. The sound collection device 19 may be configured as, for example, a microphone (a sound collector) or the like. Here, it is described that the sound collection device 19 is configured as a plurality of, that is, a pair of (two) microphones provided at the front part of the vehicle 2 while being separated from each other in the vehicle width direction, but the invention is not limited thereto. The sound collection device 19 may be configured as one microphone or three or more microphones. The sound collection device 19 is electrically connected to the ECU 9, and outputs an electric signal corresponding to the collected sound information to the ECU 9.

The assistance device 20 is mounted on each vehicle 2 and may assist the driving operation for the vehicle 2. Here, the assistance device 20 performs a driving assistance operation for suppressing the head-to-head contact. Typically, in the driving assistance operation for suppressing the head-to-head contact, the other vehicle such as an approaching crossing vehicle for the own vehicle is distinguished in an intersection or the like and an awakening operation or an automatic driving operation is performed in order to prevent the head-to-head contact when the other vehicle exists, thereby assisting the driver's driving operation. Here, the approaching crossing vehicle indicates the other vehicle which travels on a crossroad intersecting a road on which the own vehicle travels, and indicates the other vehicle which approaches the own vehicle.

The assistance device 20 includes, for example, an alarm device 21. The alarm device 21 awakens the driver by outputting driving assistance information to the driver in order to prevent the head-to-head contact. The alarm device 21 assists the driving operation by providing driving assistance information for the driver. For example, the alarm device 21 may generate various alarms by outputting alarm information as driving assistance information. The alarm device 21 may include, for example, at least one of a display and a speaker provided in a vehicle interior of the vehicle 2. The display is a visual information display device that outputs visual information (diagram information and character information). The speaker is an auditory information (voice) output device which outputs auditory information (voice information and sound information). The alarm device 21 may be an existing device provided inside a vehicle interior of the vehicle 2. For example, a display or a speaker of a navigation system may be used. The alarm device 21 provides information by outputting visual information and auditory information, so that the driver's driving operation is guided. For example, when there is a concern that the own vehicle and the other vehicle may intersect each other, the assistance device 20 awakens the driver by outputting driving assistance information through the alarm device 21 and notifying the existence of the other vehicle to the driver. Thus, a driving assistance operation may be performed which prevents the intersection with respect to the other vehicle. The alarm device 21 is electrically connected to the ECU 9 and is controlled by the ECU 9.

Further, the driving assistance apparatus 1 of the embodiment may use the steering device 4, the power source 6, and the braking device 8 as the assistance device 20. The steering device 4 assists the driving operation by automatically adjusting the rudder angle in order to prevent the head-to-head contact. For example, when there is a concern that the own vehicle and the other vehicle may intersect each other, the assistance device 20 may perform a driving assistance operation of preventing the intersection with respect to the other vehicle by turning the own vehicle through the adjustment of the rudder angle of the steering device 4. In order to prevent the head-to-head contact, the power source 6 assists the driving operation by automatically adjusting the traveling output torque and adjusting the driving force. The braking device 8 assists the driving operation by automatically adjusting the generated braking force in order to prevent the head-to-head contact. For example, when there is a concern that the own vehicle and the other vehicle may intersect each other, the assistance device 20 may perform a driving assistance operation of preventing the intersection with respect to the other vehicle by decreasing the own vehicle speed in a manner such that the driving force generated by the power source 6 decreases or the braking force generated by the braking device 8 increases.

The assistance device 20 with the above-described configuration may change the driving assistance content in accordance with the situation. The assistance device 20 may change the driving assistance content by performing a driving assistance operation using any one of, for example, the steering device 4, the power source 6, the braking device 8, and the alarm device 21. Moreover, the assistance device 20 may change the driving assistance content by changing, for example, the content of the driving assistance information output from the alarm device 21. Further, the assistance device 20 may rank the driving assistance content. For example, the assistance device 20 may position the awakening operation using the alarm device 21 as a relatively weak driving assistance operation (a driving assistance operation having a low assistance degree), and may position a vehicle control like a steering control for the steering device 4, an output control for the power source 6, and a braking control for the braking device 8 as a relatively strong driving assistance operation (a driving assistance operation having a high assistance degree).

As described above, the ECU 9 controls the driving of the units of the vehicle 2 and serves as a distinction device distinguishing the other vehicle and a control device controlling the assistance device 20. That is, the ECU 9 serves as the distinction device and the control device. Here, the ECU 9 is equipped with a traveling control unit 90, a sound source control unit 91, a sound collection unit 92, a distinction unit 93, and a driving assistance control unit 94 from the concept of a function.

Furthermore, in the description below, it is described that the distinction device and the control device are realized by the ECU 9, but the invention is not limited thereto. A configuration may be employed in which the distinction device and the control device are provided separately from the ECU 9 and information such as a detection signal, a driving signal, and a control instruction is transmitted thereamong. Similarly, a configuration may be employed in which the traveling control unit 90, the sound source control unit 91, the sound collection unit 92, the distinction unit 93, and the driving assistance control unit 94 are respectively configured as a traveling control ECU, a sound source control ECU, a sound collection ECU, a distinction ECU, and a driving assistant control ECU and information such as a detection signal, a driving signal, and a control instruction is transmitted thereamong.

The traveling control unit 90 is a traveling control means that controls the traveling of the vehicle 2. As described above, the traveling control unit 90 controls the traveling state of the vehicle 2 by controlling the units of the vehicle 2 like the EPS device 12 of the steering device 4, the power source 6, and the brake actuator 14 of the braking device 8. The sound source control unit 91 is a sound source control means that controls the sound source device 18. The sound source control unit 91 constitutes an acoustic generator 22 described in FIG. 4 along with the sound source device 18. The sound collection unit 92 is a sound collection means that performs various processes on sound information collected by the sound collection device 19. The distinction unit 93 is a distinction means that performs various distinction processes based on sound information treated by the sound collection unit 92. Accordingly, the distinction unit 93 may distinguish the other vehicle (the second vehicle 2) based on the non-audible region sound included in the sound information collected by the sound collection device 19 of the own vehicle (the first vehicle 2). The driving assistance control unit 94 is an assistance execution means that controls the assistance device 20. The driving assistance control unit 94 controls the assistance device 20 based on the distinction result obtained by the distinction unit 93. The driving assistance control unit 94 performs a driving assistance operation by controlling the assistance device 20 of the own vehicle when the distinction unit 93 of the ECU 9 detects the other vehicle. The sound collection unit 92, the distinction unit 93, and the driving assistance control unit 94 constitute an acoustic receiver 23 described in FIG. 7 along with the sound collection device 19.

FIG. 4 is a block diagram illustrating a schematic configuration example of the acoustic generator 22. The acoustic generator 22 is a device which generates a non-audible region sound. As described above, the acoustic generator 22 includes the sound source device 18 and the sound source control unit 91. The sound source control unit 91 includes an acoustic constitution unit 91*a* and an acoustic generation unit 91*b*.

The acoustic constitution unit 91*a* is an acoustic constitution means that determines the acoustic characteristic of the non-audible region sound output from the sound source device 18. The acoustic constitution unit 91*a* determines the waveform, the amplitude, the frequency, and the like as the acoustic characteristic of the non-audible region sound output from the sound source device 18. As described above, the frequency of the non-audible region sound determined herein is a predetermined frequency which is set in a frequency range which corresponds to a non-audible region of a human or an animal and a frequency range (for example, a region of 20 kHz to 100 kHz) in which a sound may be collected by the sound collection device 19. For example, the acoustic constitution unit 91*a* of the embodiment sets the non-audible region sound output from the sound source device 18 so that the sound has a waveform, an amplitude, and a frequency exemplified in FIGS. 5 and 6. That is, here, in the acoustic constitution unit 91*a*, the predetermined acoustic characteristic stored in the storage unit is set as the acoustic characteristic of the actual non-audible region sound output from the sound source device 18. In FIG. 5, the horizontal axis indicates the time, and the vertical axis indicates the amplitude. In FIG. 6, the horizontal axis indicates the frequency, and the vertical axis indicates the frequency function $F(\omega)$ obtained by a Fourier transformation.

Furthermore, the acoustic constitution unit 91*a* of the own vehicle (the first vehicle 2) and the acoustic constitution unit 91*a* of the other vehicle (the second vehicle 2) respectively may set the acoustic characteristic of the non-audible region sound output from the sound source device 18 as the same acoustic characteristic or the acoustic characteristic different in accordance with the vehicle type or the like. Here, each acoustic constitution unit 91*a* may be typically determined so that the acoustic characteristic of the non-audible region sound becomes a predetermined existing acoustic characteristic.

The acoustic generation unit 91*b* is an acoustic generation means that actually generates a non-audible region sound by controlling the sound source device 18. In the acoustic generation unit 91*b*, the acoustic constitution unit 91*a* controls the sound source device 18 based on the determined acoustic characteristic (the waveform, the amplitude, the frequency, and the like), and outputs a non-audible region sound of the determined acoustic characteristic from the sound source device 18 while the vehicle 2 travels.

FIG. 7 is a block diagram illustrating a schematic configuration example of the acoustic receiver 23. The acoustic receiver 23 is a device which performs various processes by collecting sound information around the vehicle 2. As described above, the acoustic receiver 23 includes the sound collection device 19, the sound collection unit 92, the distinction unit 93, and the driving assistance control unit 94. The sound collection unit 92 includes an acoustic acquisition unit 92*a* and an acoustic processing unit 92*b*. The distinction unit 93 includes an assistance target determination unit 93*a* and an assistance determination unit 93*b*. The driving assistance control unit 94 includes an assistance execution unit 94*a*.

The acoustic acquisition unit 92*a* is an acoustic acquisition means that acquires sound information collected by the sound collection device 19. Here, the acoustic acquisition unit 92*a* receives an electric signal corresponding to the sound information collected by the sound collection device 19.

The acoustic processing unit 92*b* is an acoustic processing means that processes and analyzes the sound information which is collected by the sound collection device 19 and is acquired by the acoustic acquisition unit 92*a*. The acoustic processing unit 92*b* processes the sound information so as to determine the existence of the other vehicle around the own vehicle based on the non-audible region sound included in the sound information acquired by the acoustic acquisition unit 92*a*. Here, the acoustic processing unit 92*b* performs, for example, a process of calculating the probability of the non-audible region sound included in the sound information collected by the pair of microphones constituting the sound collection device 19. As an example, the acoustic processing unit 92*b* performs a correlation value analysis on the sound information acquired by the acoustic acquisition unit 92*a* through various methods so as to calculate a correlation value (a similarity) between the sound information collected by one microphone constituting the sound collection device 19 and the sound information collected by the other microphone. The correlation value herein is an index that represents a degree in which the sound information collected by one microphone constituting the sound collection device 19 and the sound information collected by the other microphone are correlated with each other (are similar to each other by a certain degree). Here, the correlation (similarity) degree increases as the correlation value increases.

The assistance target determination unit 93*a* is an assistance target determination means that distinguishes the other vehicle (the second vehicle 2) based on the non-audible region sound included in the sound information collected by the sound collection device 19 of the own vehicle (the first vehicle 2). The assistance target determination unit 93*a* determines whether the other vehicle corresponding to the assistance target exists around the own vehicle based on the process result (the calculation result) of the acoustic processing unit 92*b*.

For example, when the non-audible region sound output from the sound source device 18 of the other vehicle around the own vehicle is included in the sound information acquired by the acoustic acquisition unit 92*a*, both microphones constituting the sound collection device 19 of the driving assistance apparatus 1 collect the non-audible region sound. For this reason, the correlation value which is calculated by the acoustic processing unit 92*b* becomes a relatively large value when the other vehicle exists around the own vehicle. Meanwhile, when the non-audible region sound output from the sound source device 18 of the other vehicle is not included in the sound information acquired by the acoustic acquisition unit 92*a* or the other vehicle outputting the non-audible region sound is far from the own vehicle even when the non-audible region sound is included therein, the environment noise element is superior in the sound information collected by the sound collection device 19. For this reason, the correlation value which is calculated by the acoustic processing unit 92*b* becomes a relatively small value when the other vehicle does not exist around the own vehicle.

Here, as illustrated in FIG. 8, when it is determined that the correlation value calculated by the acoustic processing unit 92*b* is larger than a correlation value threshold value ThA set in advance, the assistance target determination unit 93*a* determines that the other vehicle as the assistance target exists around the own vehicle. Meanwhile, when it is determined that the correlation value calculated by the acoustic processing unit 92*b* is the correlation value threshold value ThA set in advance or less, the assistance target determination unit 93*a* determines that the other vehicle as the assistance target does not exist around the own vehicle.

The correlation value threshold value is a threshold value which is set for the correlation value in order to determine whether to assist the driving operation by determining whether the other vehicle as the assistance target exists around the own vehicle. The correlation value threshold value is set in advance based on, for example, an actual vehicle evaluation or the like. The correlation value threshold value is set in advance by, for example, the gap with respect to the other vehicle that needs the driving assistance operation and the own vehicle. Further, there is a case in which the sound collection device 19 of the own vehicle may collect the non-audible region sound output from the sound source device 18 of the own vehicle in accordance with the arrangement positions of the sound source device 18 and the sound collection device 19 of each vehicle 2. In such a case, the correlation value threshold value may be set based on the fact that the non-audible region sound output from the sound source device 18 of the own vehicle is collected by the sound collection device 19 of the own vehicle.

Furthermore, when the sound collection device 19 is configured as one microphone, the assistance target determination unit 93*a* may distinguish the other vehicle based on, for example, the acoustic characteristic of the sound included in the sound information acquired by the acoustic acquisition unit 92*a*. In this case, the acoustic processing unit 92*b* performs, for example, a process of extracting a feature amount such as a tone and an acoustic pressure change or an amplitude and a frequency as the acoustic characteristic of the sound included in the sound information from the sound information acquired by the acoustic acquisition unit 92*a*. Then, the assistance target determination unit 93*a* distinguishes the other vehicle around the own vehicle by determining whether the acoustic characteristic of the extracted sound is correlated with the acoustic characteristic of the non-audible region sound output from the sound source device 18 of the vehicle 2. In this case, as the acoustic characteristic of the non-audible region sound output from the sound source device 18, the acoustic characteristic which is stored in the ECU 9 of the own vehicle, that is, the acoustic characteristic of the non-audible region sound output from the sound source device 18 of the own vehicle may be directly used when the driving assistance apparatus 1 of each vehicle 2 is configured so that the acoustic characteristic of the non-audible region sound of the own vehicle is the same as the acoustic characteristic of the non-audible region sound of the other vehicle. That is, the assistance target determination unit 93*a* may determine whether the acoustic characteristic of the extracted sound is correlated with the acoustic characteristic of the non-audible region sound output from the sound source device 18 of the own vehicle. Further, the acoustic characteristic of the non-audible region sound output from the sound source device 18 may be estimated as below when the driving assistance apparatus 1 of each vehicle 2 is configured so that the acoustic characteristic of the non-audible region sound of the own vehicle is different from the acoustic characteristic of the non-audible region sound of the other vehicle. That is, the assistance target determination unit 93*a* may select the acoustic characteristic of the estimatedly corresponding distinction target vehicle in accordance with the vehicle type or the like specified by the communication result with respect to the distinction target vehicle within a predetermined range through a communication unit or an image capturing result obtained by an image capturing device constituting the vehicle state detection device 17 from a plurality of acoustic characteristics of the non-audible region sound stored in accordance with the vehicle type or the like. Then, the assistance target determination unit 93*a* may determine whether the acoustic characteristic of the extracted sound is correlated with the selected acoustic characteristic. Further, when the acoustic characteristic of the non-audible region sound of the own vehicle is different from the acoustic characteristic of the non-audible region sound of the other vehicle, the assistance target determination unit 93*a* may distinguish the other vehicle around the own vehicle by determining whether the acoustic characteristic of the extracted sound is correlated with each of a plurality of acoustic characteristics of the non-audible region sound stored in accordance with the vehicle type or the like using the acoustic processing unit 92*b*.

The assistance determination unit 93*b* is an assistance determination means that determines whether to perform the driving assistance operation. The assistance determination unit 93*b* determines whether to assist the driving operation based on the determination result of the assistance target determination unit 93*a*. The assistance determination unit 93*b* determines that the driving assistance operation is performed by the assistance device 20 when the assistance target determination unit 93*a* determines that the other vehicle (the approaching vehicle) as the assistance target exists around the own vehicle. Further, the assistance determination unit 93*b* may determine the driving assistance content. For example, the assistance determination unit 93*b* changes the driving assistance content based on the correlation value calculated by the acoustic processing unit 92*b*. For example, the assistance determination unit 93*b* determines the assistance content so that a relatively strong driving assistance operation is performed when the correlation value calculated by the acoustic processing unit 92*b* is a relatively large value and determines the assistance content so that a relatively weak driving assistance operation is performed when the correlation value is a relatively small value. When the assistance target determination unit 93*a* determines that the other vehicle (the approaching vehicle) as the assistance target does not exist around the own vehicle, the assistance determination unit 93*b* determines that the driving assistance operation is not performed by the assistance device 20.

The assistance execution unit 94*a* is an assistance execution means that actually performs the driving assistance operation by the assistance device 20. When the assistance determination unit 93*b* distinguishes the other vehicle and the driving assistance operation is performed by the assistance device 20, the assistance execution unit 94*a* actually controls the assistance device 20 and performs the driving assistance operation according to the content determined by the assistance determination unit 93*b*.

Next, an example of a control that is performed by the ECU 9 will be described with reference to the flowchart of FIG. 9. Furthermore, such a control routine is repeatedly performed at a control period of several milliseconds to several tens milliseconds (the same applies to the following description).

First, the acoustic acquisition unit 92*a* acquires the sound information around the own vehicle collected by the sound collection device 19 (step ST1). Here, the acoustic acquisition unit 92*a* acquires the sound information collected by the pair of microphones constituting the sound collection device 19.

Next, the acoustic processing unit 92*b* calculates a correlation value by performing a correlation value analysis based on the sound information acquired by the acoustic acquisition unit 92*a* in step ST1 (step ST2). Here, the acoustic processing unit 92*b* calculates a correlation value between the sound information collected by one microphone constituting the sound collection device 19 and the sound information collected by the other microphone.

Next, the assistance target determination unit 93*a* determines whether the correlation value calculated by the acoustic processing unit 92*b* in step ST2 is larger than the correlation value threshold value (ThA) set in advance (step ST3).

When the assistance target determination unit 93*a* determines that the correlation value is larger than the correlation value threshold value in step ST3 (step ST3: Yes), that is, the other vehicle (the approaching vehicle) as the assistance target exists around the own vehicle, the assistance determination unit 93*b* determines that the driving assistance operation is performed by the assistance device 20 and the assistance content is determined (step ST4).

Next, the assistance execution unit 94*a* performs the driving assistance operation according to the content determined by the assistance determination unit 93*b* by controlling the assistance device 20 based on the assistance content determined by the assistance determination unit 93*b* in step ST4 (step ST5). Then, the current control period ends, and the next control period is selected.

When the assistance target determination unit 93*a* determines that the correlation value is the correlation value threshold value or less in step ST3 (step ST3: No), that is, the other vehicle (the approaching vehicle) as the assistance target does not exist around the own vehicle, the ECU 9 does not perform processes in step ST4 and step ST5, that is, the ECU does not perform the driving assistance operation. Then, the current control period ends, and the next control period is selected.

The driving assistance apparatus 1 with the above-described configuration is equipped with the sound source device 18 which generates a non-audible region sound in each vehicle 2, the sound collection device 19 which collects sound information, and the ECU 9 which serves as a distinction device. Then, the driving assistance apparatus 1 actively and mutually generates the non-audible region sound among the plurality of vehicles 2, and notifies the existence of the own vehicle to the other vehicle, so that the other vehicle around the own vehicle is distinguished. Accordingly, for example, even when the environment noise is relatively large and the traveling sound of the vehicle 2 is relatively small as in the HV vehicle or the EV vehicle, the driving assistance apparatus 1 may easily recognize the other vehicle in the own vehicle with higher precision, and the own vehicle may be easily recognized by the other vehicle with high precision. Further, the driving assistance apparatus 1 may suppress a problem in which a human or an animal feel uncomfortable by setting the sound output from the sound source device 18 as a non-audible region sound. As a result, the driving assistance apparatus 1 may suppress degradation in recognition rate for the approaching other vehicle while suppressing an influence on the surroundings, and hence may appropriately distinguish the other vehicle with high precision. Thus, the driving assistance apparatus 1 may more appropriately, assist the driving operation.

According to the driving assistance apparatus 1 of the above-described embodiment, the driving assistance apparatus includes the sound source device 18, the sound collection device 19, and the ECU 9. The sound source device 18 is mounted on the vehicle 2 and may output a non-audible region sound of a predetermined frequency range set in advance. The sound collection device 19 is mounted on the vehicle 2 and may collect the sound information around the vehicle 2. The ECU 9 may distinguish the other vehicle (the second vehicle 2) based on the non-audible region sound included in the sound information collected by the sound collection device 19 of the own vehicle (the first vehicle 2). According to the other-vehicle detection method of the above-described embodiment, the other vehicle (the second vehicle 2) is distinguished based on the non-audible region sound included in the sound information collected by the sound collection device 19 of the own vehicle (the first vehicle 2) by the use of the sound source device 18 which is mounted on the vehicle 2 and may output a non-audible region sound of a predetermined frequency range set in advance and the sound collection device 19 which is mounted on the vehicle 2 and may collect the sound information around the vehicle 2. Thus, in the driving assistance apparatus 1 and the other-vehicle detection method, the non-audible region sound is actively generated, and the other vehicle around the own vehicle is distinguished by using the non-audible region sound. As a result, the other vehicle may be appropriately distinguished and handled while suppressing an influence on the surroundings.

Further, according to the driving assistance apparatus 1 of the above-described embodiment, the driving assistance apparatus includes the assistance device 20 which is mounted on the vehicle 2 and may assist the driving operation for the vehicle 2, and performs the driving assistance operation by controlling the assistance device 20 of the own vehicle (the first vehicle 2) when the ECU 9 distinguishes the other vehicle (the second vehicle 2). Thus, the driving assistance apparatus 1 may perform the driving assistance operation by appropriately distinguishing the other vehicle.

Second Embodiment

Figure 10:
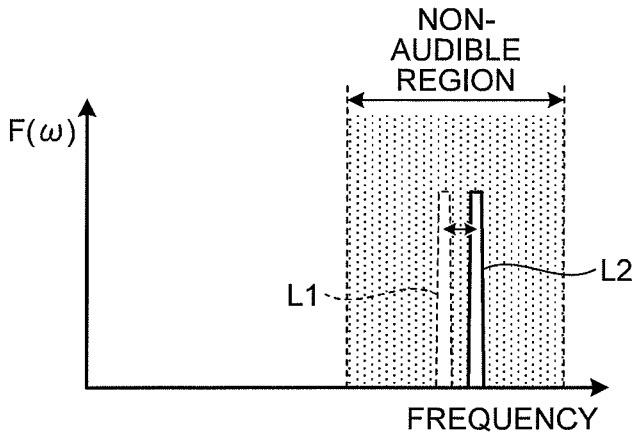
FIG. 10 is a line map illustrating an example of a distinction process content of a driving assistance apparatus according to a second embodiment.
Figure 11:
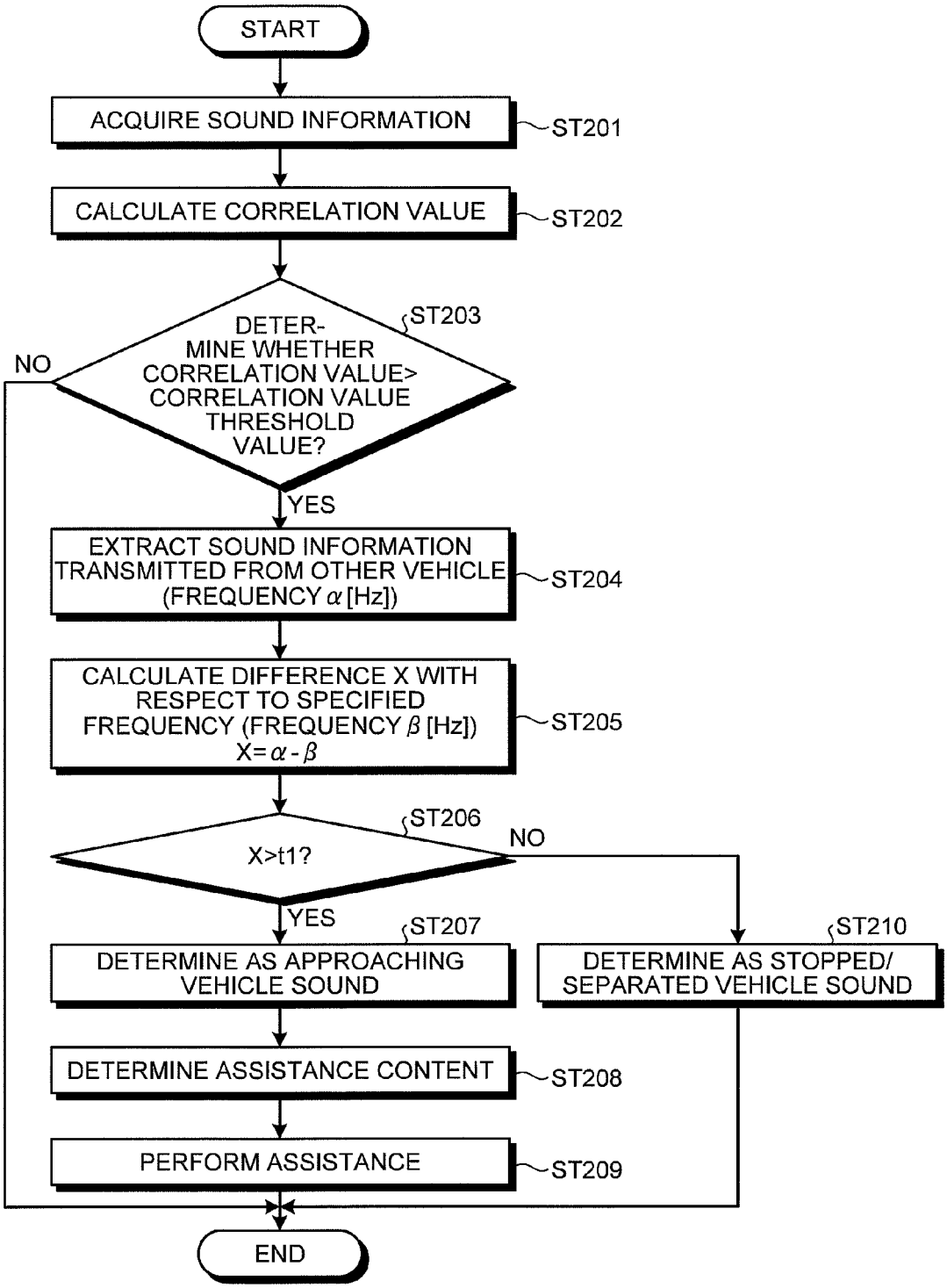
FIG. 11 is a flowchart illustrating an example of a control that is performed by an ECU of the driving assistance apparatus according to the second embodiment.

FIG. 10 is a line map illustrating an example of a distinction process content of a driving assistance apparatus according to a second embodiment. FIG. 11 is a flowchart illustrating an example of a control that is performed by an ECU of the driving assistance apparatus according to the second embodiment. The driving assistance apparatus according to the second embodiment is different from that of the first embodiment in that the process content of the distinction device is different. In addition, the configuration, the operation, and the effect which are common to those of the above-described embodiment will not be presented as much as possible. Further, the configurations of the driving assistance apparatus according to the second embodiment will be appropriately described with reference to FIGS. 1, 4, and 7.

As described above, a driving assistance apparatus 201 (see FIG. 1) is a device which performs a driving assistance operation of suppressing a head-to-head contact. However, in such a device, it is desirable to distinguish the approaching vehicle as the assistance target with high precision.

Therefore, in the driving assistance apparatus 201 (see FIG. 1) of the embodiment, the ECU 9 serving as the distinction device distinguishes the approaching vehicle as the other vehicle approaching the own vehicle and the other vehicle moving away from the own vehicle with high precision by using a so-called Doppler effect.

The ECU 9 of the embodiment distinguishes the other vehicle approaching the own vehicle based on the difference between the frequency of the non-audible region sound included in the sound information collected by the sound collection device 19 of the own vehicle (the first vehicle 2) and the frequency of the non-audible region sound output from the sound source device 18 of the other vehicle (the second vehicle 2).

Specifically, the acoustic processing unit 92*b* (see FIG. 7) of the sound collection unit 92 of the embodiment performs a correlation value analysis and a frequency analysis on the sound information collected by the sound collection device 19 and acquired by the acoustic acquisition unit 92*a*. The acoustic processing unit 92*b* performs a frequency analysis on the sound information acquired by the acoustic acquisition unit 92*a* by various methods such as a Fourier transformation.

For example, when the non-audible region sound output from the sound source device 18 of the own vehicle around the other vehicle is included in the sound information acquired by the acoustic acquisition unit 92*a*, the driving assistance apparatus 201 extracts a frequency in accordance with the non-audible region sound by the frequency analysis of the acoustic processing unit 92*b*. At this time, when the relative distance between the own vehicle and the other vehicle changes, the frequency of the non-audible region sound which is actually collected by the sound collection device 19 of the own vehicle is displaced from the original frequency of the non-audible region sound which is output from the sound source device 18 of the other vehicle by the Doppler effect. For this reason, when the other vehicle moves closes to the own vehicle, the frequency of the non-audible region sound L2 which is extracted by the analysis of the acoustic processing unit 92*b* is displaced to the high frequency side in relation to the original frequency of the non-audible region sound L1 output from the sound source device 18 of the other vehicle (the second vehicle 2) in that the approaching vehicle moves close to the own vehicle at the speed as illustrated in FIG. 10. On the contrary, when the other vehicle moves away from the own vehicle, the frequency of the non-audible region sound which is extracted by the analysis of the acoustic processing unit 92*b* is displaced to the low frequency side from the original frequency of the non-audible region sound output from the sound source device 18 of the other vehicle in that the approaching vehicle moves away from the own vehicle at the speed. Further, when the other vehicle is stopped, the frequency of the non-audible region sound which is extracted by the analysis of the acoustic processing unit 92*b* is substantially the same as the original frequency of the non-audible region sound output from the sound source device 18 of the other vehicle. Based on this, the ECU 9 distinguishes the approaching vehicle as the other vehicle approaching the own vehicle, the other vehicle moving away from the own vehicle, and the stopped/separated vehicle as the stopped other vehicle.

Here, the acoustic processing unit 92*b* calculates the difference between the frequency of the non-audible region sound extracted by the analysis of the acoustic processing unit 92*b* of the own vehicle and the original frequency of the non-audible region sound output from the sound source device 18 of the other vehicle. Here, the original frequency of the non-audible region sound output from the sound source device 18 of the other vehicle is the existing frequency which is specified in advance by the acoustic constitution unit 91*a* of the other vehicle as described above. Hereinafter, the original frequency of the non-audible region sound output from the sound source device 18 of the other vehicle will be referred to as the "specified frequency". The acoustic processing unit 92*b* calculates the difference X by using, for example, the following equation (1) when the frequency of the non-audible region sound extracted by the analysis is indicated by "α" and the specified frequency is indicated by "β".

$$X=\alpha-\beta \quad (1)$$

Here, when the driving assistance apparatus 201 of each vehicle 2 is configured so that the frequency of the non-audible region sound of the own vehicle is the same as the frequency of the non-audible region sound of the other vehicle, the frequency of the acoustic characteristic stored in the storage unit of the ECU 9 of the own vehicle, that is, the acoustic characteristic of the non-audible region sound output from the sound source device 18 of the own vehicle may be directly used as the original frequency of the non-audible region sound (the specified frequency) output from the sound source device 18 of the other vehicle. That is, the acoustic processing unit 92*b* may calculate the difference X based on the frequency α of the non-audible region sound extracted by the analysis in the own vehicle and the frequency of the non-audible region sound (corresponding to the specified frequency β) output from the sound source device 18 of the own vehicle. Further, when the driving assistance apparatus 201 of each vehicle 2 is configured so that the frequency of the non-audible region sound of the own vehicle is different from the frequency of the non-audible region sound of the other vehicle, the original frequency (the specified frequency) of the non-audible region sound output from the sound source device 18 of the other vehicle may be estimated by using, for example, various methods as below. That is, the acoustic processing unit 92*b* may select the estimatedly corresponding frequency of the other vehicle in accordance with the vehicle type or the like specified by the communication result with respect to the distinction target vehicle within a predetermined range through a communication unit or the image capturing result of the image capturing device constituting the vehicle state detection device 17 from a plurality of frequencies of the non-audible region sound stored in accordance with the vehicle type or the like. Then, the acoustic processing unit 92*b* may calculate the difference X based on the frequency α of the non-audible region sound extracted by the analysis in the own vehicle and the selected frequency (corresponding to the specified frequency β).

Then, the assistance target determination unit 93*a* of the embodiment determines whether the other vehicle as the assistance target exists around the own vehicle based on the process result (the calculation result) obtained by the acoustic processing unit 92*b* and determines whether the other vehicle is the approaching vehicle when the other vehicle exists.

The assistance target determination unit 93*a* determines whether the difference X calculated by the acoustic processing unit 92*b* is larger than a threshold value t1 set in advance. The threshold value t1 is a threshold value which is set for the difference X in order to determine whether the approaching vehicle as the assistance target exists around the own vehicle and to determine whether to perform the driving assistance operation, and is set in advance based on the actual vehicle evaluation or the like. The threshold value t1 is set in advance in accordance with, for example, a value used to distinguish the approaching vehicle and the stopped/separated vehicle.

When it is determined that the difference X calculated by the acoustic processing unit 92*b* is larger than the threshold value t1, the assistance target determination unit 93*a* determines that the other vehicle around the own vehicle is the approaching vehicle. Here, the case in which the difference X is larger than the threshold value t1 set in advance indicates a case in which the frequency of the non-audible region sound extracted by the analysis of the acoustic processing unit 92*b* of the own vehicle is displaced to a high frequency side from the specified frequency. For this reason, when the frequency of the non-audible region sound extracted by the analysis of the acoustic processing unit 92*b* of the own vehicle is displaced to the high frequency side from the specified frequency, the assistance target determination unit 93*a* determines that the other vehicle around the own vehicle is the approaching vehicle. Accordingly, the assistance target determination unit 93*a* determines that the approaching vehicle as the assistance target exists around the own vehicle.

Meanwhile, when it is determined that the difference X calculated by the acoustic processing unit 92*b* is the threshold value t1 or less, the assistance target determination unit 93*a* determines that the approaching vehicle does not exist around the own vehicle. Here, the case in which the difference X is the predetermined threshold value t1 set in advance or less indicates the case in which the frequency of the non-audible region sound extracted by the analysis of the acoustic processing unit 92*b* of the own vehicle is displaced to the low frequency side from the specified frequency and the case in which the frequency of the extracted non-audible region sound is the same as the specified frequency. For this reason, when the frequency of the non-audible region sound extracted by the analysis of the acoustic processing unit 92*b* of the own vehicle is displaced to the low frequency side from the specified frequency, the assistance target determination unit 93*a* determines that the stopped/separated vehicle exists around the own vehicle, but the approaching vehicle does not exist around the own vehicle. Accordingly, the assistance target determination unit 93*a* determines that the approaching vehicle as the assistance target does not exist around the own vehicle.

Then, the assistance determination unit 93*b* determines whether to perform the driving assistance operation based on the determination result of the assistance target determination unit 93*a*. When the assistance target determination unit 93*a* determines that the other vehicle is the approaching vehicle, the assistance determination unit 93*b* determines that the driving assistance operation is performed by the assistance device 20 by setting the approaching vehicle as the assistance target. Then, the assistance determination unit 93*b* determines, for example, the driving assistance content in accordance with the difference X or the like. Meanwhile, when the assistance target determination unit 93*a* determines that the other vehicle is the stopped/separated vehicle, the assistance determination unit 93*b* determines that the driving assistance operation is not performed by the assistance device 20 without setting the stopped/separated vehicle as the assistance target.

Next, an example of a control that is performed by the ECU 9 will be described with reference to the flowchart of FIG. 11.

First, the acoustic acquisition unit 92*a* acquires the sound information around the own vehicle collected by the sound collection device 19 (step ST201).

Next, the acoustic processing unit 92*b* calculates a correlation value by performing a correlation value analysis based on the sound information acquired by the acoustic acquisition unit 92*a* in step ST201 (step ST202).

Next, the assistance target determination unit 93*a* determines whether the correlation value calculated by the acoustic processing unit 92*b* in step ST202 is larger than a correlation value threshold value (ThA) set in advance (step ST203). When the assistance target determination unit 93*a* determines that the correlation value is the correlation value threshold value or less in step ST203 (step ST203: No), the ECU 9 ends the current control period and selects the next control period.

When the assistance target determination unit 93*a* determines that the correlation value is larger than the correlation value threshold value in step ST203 (step ST203: Yes), that is, the other vehicle is distinguished, the acoustic processing unit 92*b* performs a frequency analysis on the sound information acquired by the acoustic acquisition unit 92*a* in step ST201. Accordingly, the acoustic processing unit 92*b* extracts the sound information transmitted from the other vehicle and extracts the frequency $\alpha$ of the non-audible region sound (step ST204).

Next, the acoustic processing unit 92*b* calculates the difference X between the frequency $\alpha$ of the non-audible region sound extracted by the acoustic processing unit 92*b* in step ST204 and the specified frequency $\beta$ (step ST205). The acoustic processing unit 92*b* calculates the difference X by using, for example, the above-described equation (1).

Next, the assistance target determination unit 93*a* determines whether the difference X calculated by the acoustic processing unit 92*b* in step ST205 is larger than the threshold value t1 set in advance (step ST206).

When the assistance target determination unit 93*a* determines that the difference X is larger than the threshold value t1 in step ST206 (step ST206: Yes), the assistance target determination unit 93*a* determines that the collected non-audible region sound is the sound of the approaching vehicle (step ST207).

Next, the assistance determination unit 93*b* determines that the driving assistance operation is performed by the assistance device 20 and determines the assistance content (step ST208).

Next, the assistance execution unit 94*a* performs the driving assistance operation according to the content determined by the assistance determination unit 93*b* by controlling the assistance device 20 based on the assistance content determined by the assistance determination unit 93*b* in step ST208 (step ST209). Then, the current control period ends, and the next control period is selected.

When the assistance target determination unit 93*a* determines that the difference X is the threshold value t1 or less in step ST206 (step ST206: No), the assistance target determination unit 93*a* determines that the collected non-audible region sound is the sound of the stopped/separated vehicle (step ST210).

Then, the ECU 9 does not perform processes in step ST208 and step ST209, that is, the ECU 9 does not assist the driving operation. Subsequently, the current control period ends, and the next control period is selected.

The driving assistance apparatus 201 according to the above-described embodiment actively and mutually generates the non-audible region sound among the plurality of vehicles 2, and notifies the existence of the own vehicle to the other vehicle by using the non-audible region sound, so that the other vehicle around the own vehicle may be distinguished. As a result, the driving assistance apparatus 201 may appropriately distinguish and handle the other vehicle.

Further, according to the driving assistance apparatus 201 of the above-described embodiment, the ECU 9 distinguishes the approaching vehicle based on the difference between the frequency of the non-audible region sound included in the sound information collected by the sound collection device 19 of the own vehicle and the frequency of the non-audible region sound output from the sound source device 18 of the other vehicle.

Thus, the driving assistance apparatus 201 may distinguish the approaching vehicle and the stopped/separated vehicle with high precision by distinguishing the other vehicle by using a so-called Doppler effect. As a result, since the driving assistance apparatus 201 may improve the distinction precision of the approaching vehicle as the driving assistance target for suppressing the head-to-head contact, it is possible to suppress a problem in which the driving assistance operation is unnecessarily performed even when the other vehicle around the own vehicle is the stopped/separated vehicle. Accordingly, the driving assistance apparatus 201 may appropriately assist the driving operation while suppressing the discomfort of the driver.

Third Embodiment

Figure 12:
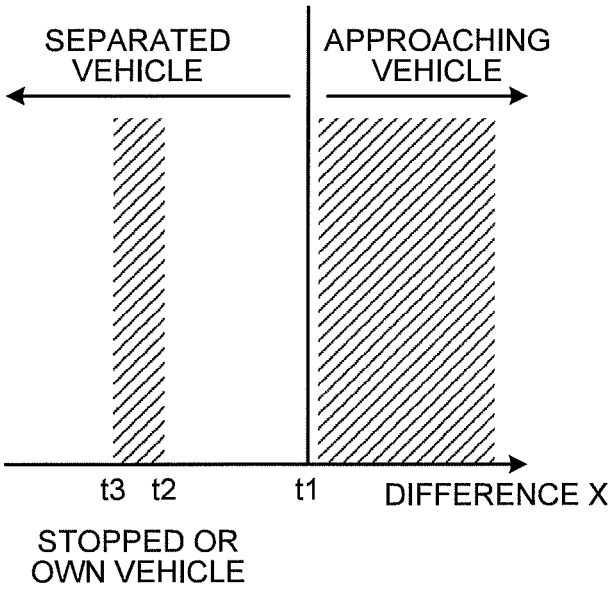
FIG. 12 is a line map illustrating an example of a threshold value of a driving assistance apparatus according to a third embodiment.
Figure 13:
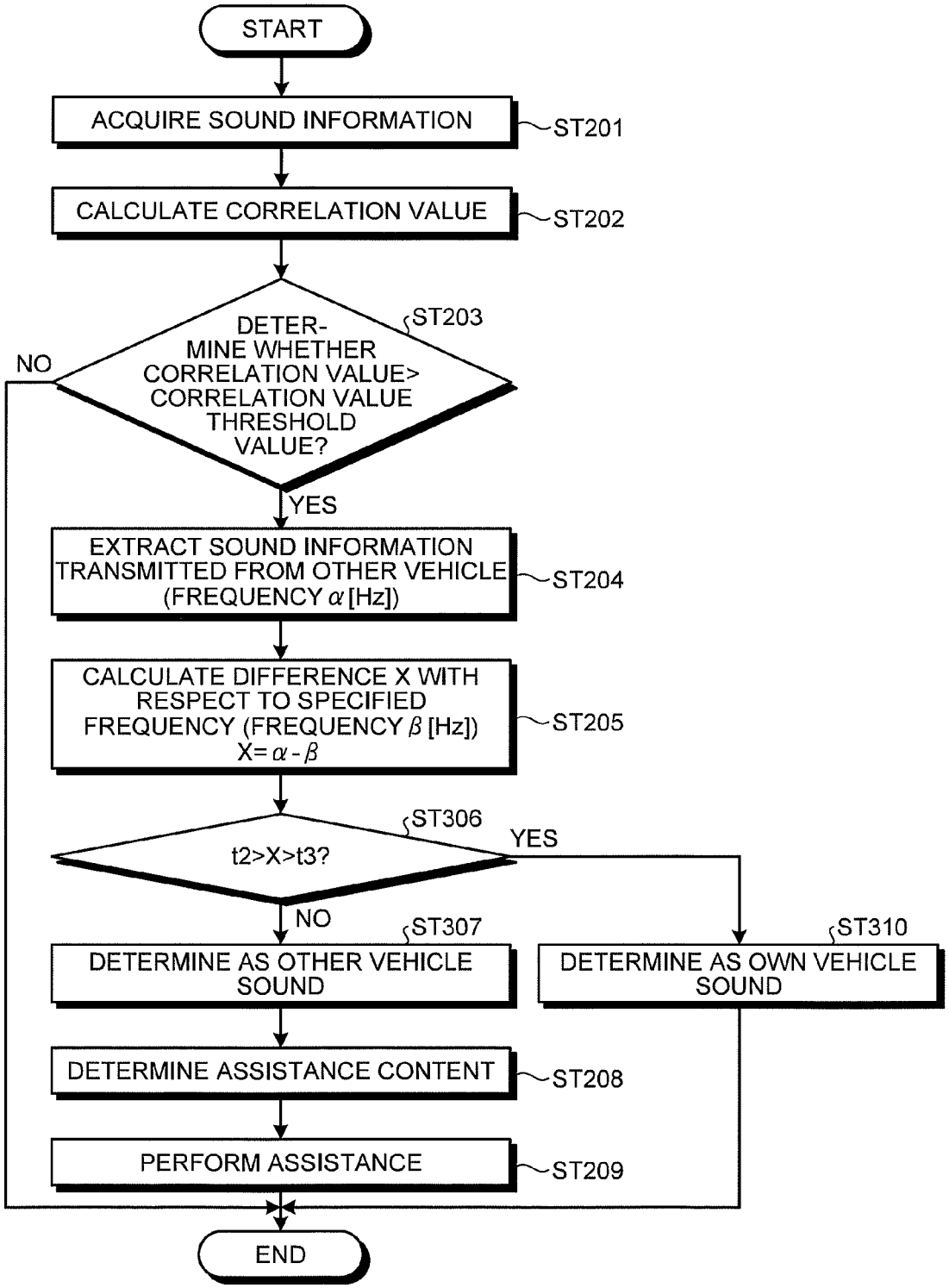
FIG. 13 is a flowchart illustrating an example of a control that is performed by an ECU of the driving assistance apparatus according to the third embodiment.

FIG. 12 is a line map illustrating an example of a threshold value of a driving assistance apparatus according to a third embodiment. FIG. 13 is a flowchart illustrating an example of a control that is performed by an ECU of the driving assistance apparatus according to the third embodiment. The driving assistance apparatus according to the third embodiment is different from those of the first and second embodiments in that the process content of the distinction device is different.

As described above, there is a case in which a driving assistance apparatus 301 (see FIG. 1) which is mounted on each vehicle 2 is configured so that the acoustic characteristic of the non-audible region sound of the own vehicle is the same as the acoustic characteristic of the non-audible region sound of the other vehicle. In this case, it is desirable that the driving assistance apparatus 301 distinguish between the own vehicle and the other vehicle as the assistance target with high precision.

Therefore, the driving assistance apparatus 301 (see FIG. 1) of the embodiment is configured to distinguish between the own vehicle and the other vehicle with high precision in a manner such that the ECU 9 serving as the distinction device distinguishes the other vehicle by using the Doppler effect similarly to the second embodiment.

When the frequency of the non-audible region sound output from the sound source device 18 of the own vehicle (the first vehicle 2) is the same as the frequency of the non-audible region sound output from the sound source device 18 of the other vehicle (the second vehicle 2), the ECU 9 of the embodiment distinguishes between the own vehicle and the other vehicle based on the difference X. That is, the ECU 9 distinguishes between the own vehicle and the other vehicle based on the difference between the frequency of the non-audible region sound included in the sound information collected by the sound collection device 19 of the own vehicle and the frequencies of the non-audible region sounds output from the sound source devices 18 of the own vehicle and the other vehicle.

Specifically, the acoustic processing unit 92*b* (see FIG. 7) of the sound collection unit 92 of the embodiment performs a frequency analysis on the sound information acquired by the acoustic acquisition unit 92*a* by various methods such as a Fourier transformation. Then, the acoustic processing unit 92*b* calculates the difference X between the frequency α of the non-audible region sound extracted by the analysis of the acoustic processing unit 92*b* of the own vehicle and the specified frequency β (the original frequency of the non-audible region sound output from the sound source device 18 of the other vehicle).

Then, the assistance target determination unit 93*a* of the embodiment determines whether the difference X calculated by the acoustic processing unit 92*b* is larger than a threshold value t3 set in advance and is smaller than a threshold value t2. That is, the assistance target determination unit 93*a* determines whether the difference X satisfies the condition of [t3<X<t2]. The threshold values t2 and t3 are threshold values which are set in the difference X in order to determine whether to perform the driving assistance operation by determining whether the sound collected by the sound collection device 19 is the sound of the own vehicle and the approaching vehicle as the assistance target exists around the own vehicle, and are set in advance based on the actual vehicle evaluation or the like. Typically, as illustrated in FIG. 12, the threshold values t2 and t3 are set to the low frequency side in relation to the threshold value t1 which is set to distinguish the approaching vehicle. For example, the threshold values t2 and t3 are set in advance in accordance with the value used to separately distinguish the own vehicle, the approaching vehicle, and the separated vehicle, and the range of the threshold value t2 to the threshold value t3 is typically set around zero. Furthermore, the threshold value t2 may be set to be equal to the threshold value t1.

When it is determined that the difference X calculated by the acoustic processing unit 92*b* is larger than the threshold value t3 and is smaller than the threshold value t2, the assistance target determination unit 93*a* determines that the sound collected by the sound collection device 19 is the sound of the own vehicle. Here, the case in which the difference X is larger than the threshold value t3 and is smaller than the threshold value t2 indicates the case in which the frequency of the non-audible region sound extracted by the analysis of the acoustic processing unit 92*b* of the own vehicle is substantially the same as the specified frequency. When the non-audible region sound output from the sound source device 18 of the own vehicle is collected by the sound collection device 19 of the own vehicle, the frequency of the non-audible region sound extracted by the analysis of the acoustic processing unit 92*b* substantially does not change while being substantially the same as the original frequency of the non-audible region sound output from the sound source device 18 of the own vehicle. For this reason, when the frequency of the non-audible region sound extracted by the analysis of the acoustic processing unit 92*b* of the own vehicle is substantially the same as the specified frequency, the assistance target determination unit 93*a* determines that the sound collected by the sound collection device 19 is the sound of the own vehicle. Accordingly, the assistance target determination unit 93*a* determines that the other vehicle as the assistance target does not exist around the own vehicle. Further, in this case, there is a concern that the assistance target determination unit 93*a* may distinguish the stopped vehicle as the own vehicle. However, even in this case, the driving assistance operation may not be performed. For this reason, since it is determined that the other vehicle as the assistance target does not exist around the own vehicle, any problem substantially does not occur.

Meanwhile, when it is determined that the difference X calculated by the acoustic processing unit 92*b* is the threshold value t3 or less or the threshold value t2 or more, the assistance target determination unit 93*a* determines that the sound collected by the sound collection device 19 is the sound of the other vehicle. Here, the determination case in which the difference X is the threshold value t3 or less or the threshold value t2 or more indicates the case in which the frequency of the non-audible region sound extracted by the analysis of the acoustic processing unit 92*b* of the own vehicle is displaced from the specified frequency. For this reason, when the frequency of the non-audible region sound extracted by the analysis of the acoustic processing unit 92*b* of the own vehicle is displaced from the specified frequency by a predetermined amount, that is, the relative distance between the own vehicle and the other vehicle changes, the assistance target determination unit 93*a* determines that the sound collected by the sound collection device 19 is the sound of the other vehicle. Accordingly, the assistance target determination unit 93*a* may determine that the other vehicle as the assistance target exists around the own vehicle. Further, in this case, the assistance target determination unit 93*a* may further distinguish between the approaching vehicle and the stopped/separated vehicle described in the second embodiment and hence may distinguish the approaching vehicle as the assistance target with higher precision.

Then, the assistance determination unit 93*b* determines whether to perform the driving assistance operation based on the determination result of the assistance target determination unit 93*a*. When the assistance target determination unit 93*a* distinguishes the other vehicle, the assistance determination unit 93*b* sets the other vehicle as the assistance target and determines that the driving assistance operation is performed by the assistance device 20. Then, the assistance determination unit 93*b* determines the driving assistance content in accordance with, for example, the difference X or the like. Meanwhile, the assistance determination unit 93*b* determines that the driving assistance operation is not performed by the assistance device 20 when the assistance target determination unit 93*a* distinguishes the own vehicle (including the stopped vehicle).

Next, an example of a control that is performed by the ECU 9 will be described with reference to the flowchart of FIG. 13. Further, even in this case, since the processes are substantially the same as those of the flowchart described in FIG. 11 except for step ST306, step ST307, and step ST310, the description thereof will be omitted as much as possible.

After step ST205, the assistance target determination unit 93*a* determines whether the difference X calculated by the acoustic processing unit 92*b* in step ST205 is larger than the threshold value t3 set in advance and is smaller than the threshold value t2 (step ST306).

When the assistance target determination unit 93*a* determines that the difference X is the threshold value t3 or less or the threshold value t2 or more in step ST306 (step ST306: No), the assistance target determination unit 93*a* determines that the collected non-audible region sound is the sound of the other vehicle (step ST307), and performs a process in step ST208.

When the assistance target determination unit 93*a* determines that the difference X is larger than the threshold value t3 and is smaller than the threshold value t2 in step ST306 (step ST306: Yes), the assistance target determination unit 93*a* determines that the collected non-audible region sound is the sound of the own vehicle (step ST310).

Then, the ECU 9 does not perform processes in step ST208 and step ST209, that is, the driving assistance operation. Subsequently, the current control period ends, and the next control period is selected.

Furthermore, the assistance target determination unit 93*a* may perform a determination process in step ST206 (see FIG. 11) described in the second embodiment after the process in step ST307 when the approaching vehicle and the stopped/separated vehicle described in the second embodiment are also distinguished. Then, when the assistance target determination unit 93*a* determines that the difference X is larger than the threshold value t1 in step ST206 (step ST206: Yes), the ECU 9 may perform processes in step ST207 (see FIG. 11), step ST208, and step ST209. When the assistance target determination unit 93*a* determines that the difference X is the threshold value t1 or less in step ST206 (step ST206: No), the ECU 9 performs a process in step ST210 (see FIG. 11). Subsequently, the current control period ends, and the next control period may be selected. Accordingly, the driving assistance apparatus 301 may distinguish the approaching vehicle as the assistance target with higher precision.

The driving assistance apparatus 301 according to the above-described embodiment actively and mutually generates the non-audible region sound in the plurality of vehicles 2, and notifies the existence of the own vehicle to the other vehicle by using the non-audible region sound, so that the other vehicle around the own vehicle may be distinguished. As a result, the driving assistance apparatus 301 may appropriately distinguish and handle the other vehicle.

Further, according to the driving assistance apparatus 301 of the above-described embodiment, the ECU 9 performs the following process when the frequency of the non-audible region sound output from the sound source device 18 of the own vehicle (the first vehicle 2) is the same as the frequency of the non-audible region sound output from the sound source device 18 of the other vehicle (the second vehicle 2). That is, in this case, the ECU 9 distinguishes the own vehicle and the traveling other vehicle based on the difference between the frequency of the non-audible region sound included in the sound information collected by the sound collection device 19 of the own vehicle and the frequencies of the non-audible region sounds output from the sound source devices 18 of the own vehicle and the other vehicle.

Thus, since the driving assistance apparatus 301 distinguishes between the own vehicle and the traveling other vehicle by using a so-called Doppler effect, it is possible to suppress a problem in which the existence of the other vehicle is erroneously distinguished by the sound output from the own vehicle even when the acoustic characteristic of the non-audible region sound of the own vehicle is the same as the acoustic characteristic of the non-audible region sound of the other vehicle. Accordingly, the driving assistance apparatus 301 may distinguish between the own vehicle and the other vehicle with high precision. As a result, since the driving assistance apparatus 301 may improve the distinction precision for the own vehicle and the other vehicle as the driving assistance target in order to suppress the head-to-head contact, it is possible to suppress the unnecessary driving assistance operation. Accordingly, the driving assistance apparatus 301 may appropriately assist the driving operation while suppressing the trouble of the driver.

Fourth Embodiment

Figure 14:
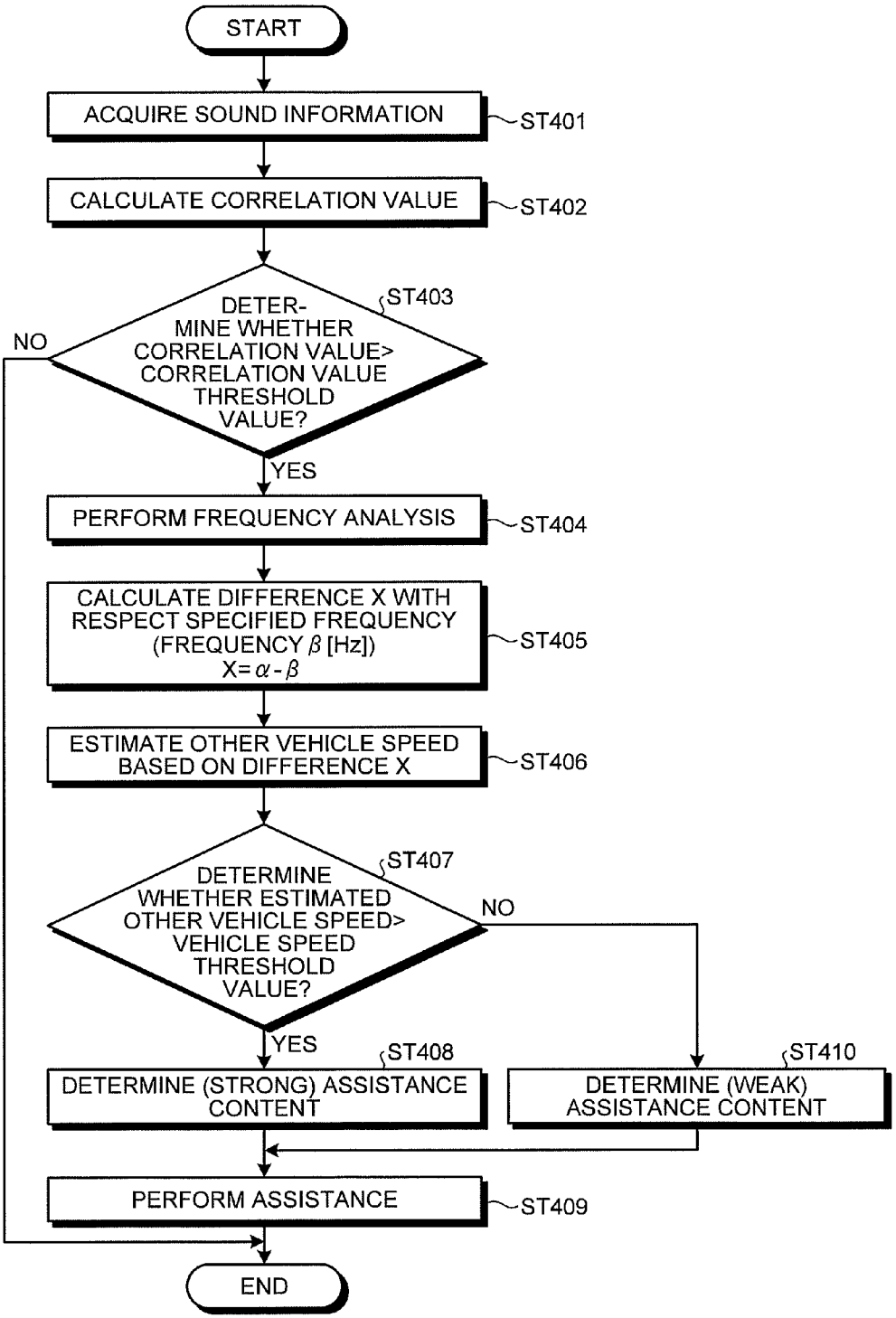
FIG. 14 is a flowchart illustrating an example of a control that is performed by an ECU of a driving assistance apparatus according to a fourth embodiment.

FIG. 14 is a flowchart illustrating an example of a control that is performed by an ECU of a driving assistance apparatus according to a fourth embodiment. The driving assistance apparatus according to the fourth embodiment is different from those of the first, second, and third embodiments in that the process content of the distinction device is different.

As described above, a driving assistance apparatus 401 (see FIG. 1) is a device which performs a driving assistance operation for suppressing the head-to-head contact when the existence of the approaching vehicle with respect to the own vehicle is distinguished. However, it is desirable to change the driving assistance content in accordance with the approaching vehicle state.

Therefore, the driving assistance apparatus 401 (see FIG. 1) of the embodiment changes the driving assistance content in accordance with the information relating to the other vehicle distinguished by the ECU 9 serving as the distinction device.

The ECU 9 of the embodiment changes the driving assistance content of the assistance device 20 in the own vehicle in accordance with the information relating to the other vehicle based on the non-audible region sound included in the sound information collected by the sound collection device 19 of the own vehicle. Here, the ECU 9 estimates the vehicle speed of the other vehicle by using the Doppler effect and determines the driving assistance degree.

Specifically, the acoustic processing unit 92*b* (see FIG. 7) of the sound collection unit 92 of the embodiment also serves as the other vehicle information calculation means that calculates the other vehicle information as the information relating to the other vehicle based on the non-audible region sound included in the sound information collected by the sound collection device 19 of the own vehicle. Here, the acoustic processing unit 92*b* calculates the other vehicle speed as the vehicle speed of the other vehicle by using the Doppler effect as the other vehicle information. The acoustic processing unit 92*b* calculates the other vehicle speed of the other vehicle based on the difference between the frequency of the non-audible region sound included in the sound information collected by the sound collection device 19 of the own vehicle and the frequency of the non-audible region sound output from the sound source device 18 of the other vehicle.

More specifically, the acoustic processing unit 92*b* performs a frequency analysis on the sound information acquired by the acoustic acquisition unit 92*a* by various methods such as a Fourier transformation. Then, the acoustic processing unit 92*b* calculates the difference X between the frequency $\alpha$ of the non-audible region sound extracted by the analysis of the acoustic processing unit 92*b* of the own vehicle and the specified frequency $\beta$ (the original frequency of the non-audible region sound output from the sound source device 18 of the other vehicle).

As the difference X relatively increases, the amount of the frequency $\alpha$ of the non-audible region sound extracted by the analysis of the acoustic processing unit 92*b* of the own vehicle shifted to the high frequency side with respect to the specified frequency $\beta$ increases. The amount in which the frequency $\alpha$ is shifted to the high frequency side with respect to the frequency $\beta$ relatively increases as the approaching speed of the other vehicle facing the own vehicle relatively increases by the Doppler effect. That is, the approaching speed of the other vehicle facing the own vehicle relatively increases as the difference X relatively increases. The acoustic processing unit 92*b* calculates the other vehicle speed by using the correlation between the difference X and the other vehicle speed.

In this case, the ECU 9 stores the other vehicle speed estimation map in which a correlation between the difference X and the other vehicle speed is specified in advance based on the actual vehicle evaluation or the like in a storage unit. Then, the acoustic processing unit 92*b* calculates the other vehicle speed from the difference X based on the other vehicle speed estimation map.

Then, the assistance determination unit 93*b* changes the driving assistance content of the assistance device 20 in the own vehicle based on the other vehicle speed calculated by the acoustic processing unit 92*b*. For example, when the calculated other vehicle speed is a relatively large value, that is, the approaching vehicle moves close to the own vehicle at the relatively fast speed, the assistance determination unit 93*b* determines the assistance content so that the driving assistance operation is relatively strong. Meanwhile, for example, when the calculated other vehicle speed is a relatively small value, that is, the approaching vehicle moves close to the own vehicle at the relatively slow speed, the assistance determination unit 93*b* determines the assistance content so that the driving assistance operation is relatively weak.

Next, an example of a control that is performed by the ECU 9 will be described with reference to the flowchart of FIG. 14.

First, the acoustic acquisition unit 92*a* acquires the sound information around the own vehicle collected by the sound collection device 19 (step ST401).

Next, the acoustic processing unit 92*b* calculates a correlation value by performing a correlation value analysis based on the sound information acquired by the acoustic acquisition unit 92*a* in step ST401 (step ST402).

Next, the assistance target determination unit 93*a* determines whether the correlation value calculated by the acoustic processing unit 92*b* in step ST402 is larger than the correlation value threshold value (ThA) set in advance (step ST403). When the assistance target determination unit 93*a* determines that the correlation value is the correlation value threshold value or less in step ST403 (step ST403: No), the ECU 9 ends the current control period and selects the next control period.

When the assistance target determination unit 93*a* determines that the correlation value is larger than the correlation value threshold value in step ST403 (step ST403: Yes), the acoustic processing unit 92*b* performs a frequency analysis on the sound information acquired by the acoustic acquisition unit 92*a* in step ST401. Accordingly, the acoustic processing unit 92*b* extracts the sound information transmitted from the other vehicle and extracts the frequency $\alpha$ of the non-audible region sound (step ST404).

Next, the acoustic processing unit 92*b* calculates the difference X between the frequency $\alpha$ of the non-audible region sound extracted by the acoustic processing unit 92*b* in step ST404 and the specified frequency $\beta$ (step ST405).

Next, the acoustic processing unit 92*b* estimates the other vehicle speed based on the difference X calculated by the acoustic processing unit 92*b* in step ST405 (step ST406). The acoustic processing unit 92*b* calculates and estimates the other vehicle speed from the difference X, for example, based on the other vehicle speed estimation map.

Then, the assistance determination unit 93*b* determines whether the other vehicle speed estimated by the acoustic processing unit 92*b* in step ST406 is larger than a vehicle speed threshold value set in advance (step ST407). Here, the vehicle speed threshold value may be set in advance based on the approaching speed or the like of the other vehicle that needs a relative strong driving assistance operation.

When the assistance determination unit 93*b* determines that the other vehicle speed is larger than the vehicle speed threshold value in step ST407 (step ST407: Yes), the assistance determination unit 93*b* determines the assistance content so that a relatively strong driving assistance operation is performed (step ST408).

Next, the assistance execution unit 94*a* performs the driving assistance operation according to the content determined by the assistance determination unit 93*b* by controlling the assistance device 20 based on the assistance content determined by the assistance determination unit 93*b* in step ST408 (step ST409). Then, the current control period ends, and the next control period is selected.

When the assistance determination unit 93*b* determines that the other vehicle speed is the vehicle speed threshold value or less in step ST407 (step ST407: No), the assistance determination unit 93*b* determines the assistance content so that a relatively weak driving assistance operation is performed (step ST410).

Next, the assistance execution unit 94*a* performs the driving assistance operation according to the content determined by the assistance determination unit 93*b* by controlling the assistance device 20 based on the assistance content determined by the assistance determination unit 93*b* in step ST410 (step ST409). Then, the current control period ends, and the next control period is selected.

The driving assistance apparatus 401 according to the above-described embodiment actively and mutually generates the non-audible region sound in the plurality of vehicles 2, and notifies the existence of the own vehicle to the other vehicle by using the non-audible region sound, so that the other vehicle around the own vehicle may be distinguished. As a result, the driving assistance apparatus 401 may appropriately distinguish and handle the other vehicle.

Further, according to the driving assistance apparatus 401 of the above-described embodiment, the ECU 9 changes the driving assistance content of the assistance device 20 in the own vehicle in accordance with the information relating to the other vehicle based on the non-audible region sound included in the sound information collected by the sound collection device 19 of the own vehicle. Here, the ECU 9 calculates the vehicle speed of the other vehicle based on the difference between the frequency of the non-audible region sound included in the sound information collected by the sound collection device 19 of the own vehicle and the frequency of the non-audible region sound output from the sound source device 18 of the other vehicle as the information relating to the other vehicle. Accordingly, the driving assistance apparatus 401 may more appropriately determine the other vehicle state. Then, the ECU 9 changes the driving assistance content of the assistance device 20 in the own vehicle based on the calculated vehicle speed of the other vehicle. Thus, the driving assistance apparatus 401 may assist the driving operation without any discomfort for the driver in accordance with the other vehicle state in that the assistance content is determined based on the other vehicle speed as the other vehicle information.

Fifth Embodiment

Figure 15:
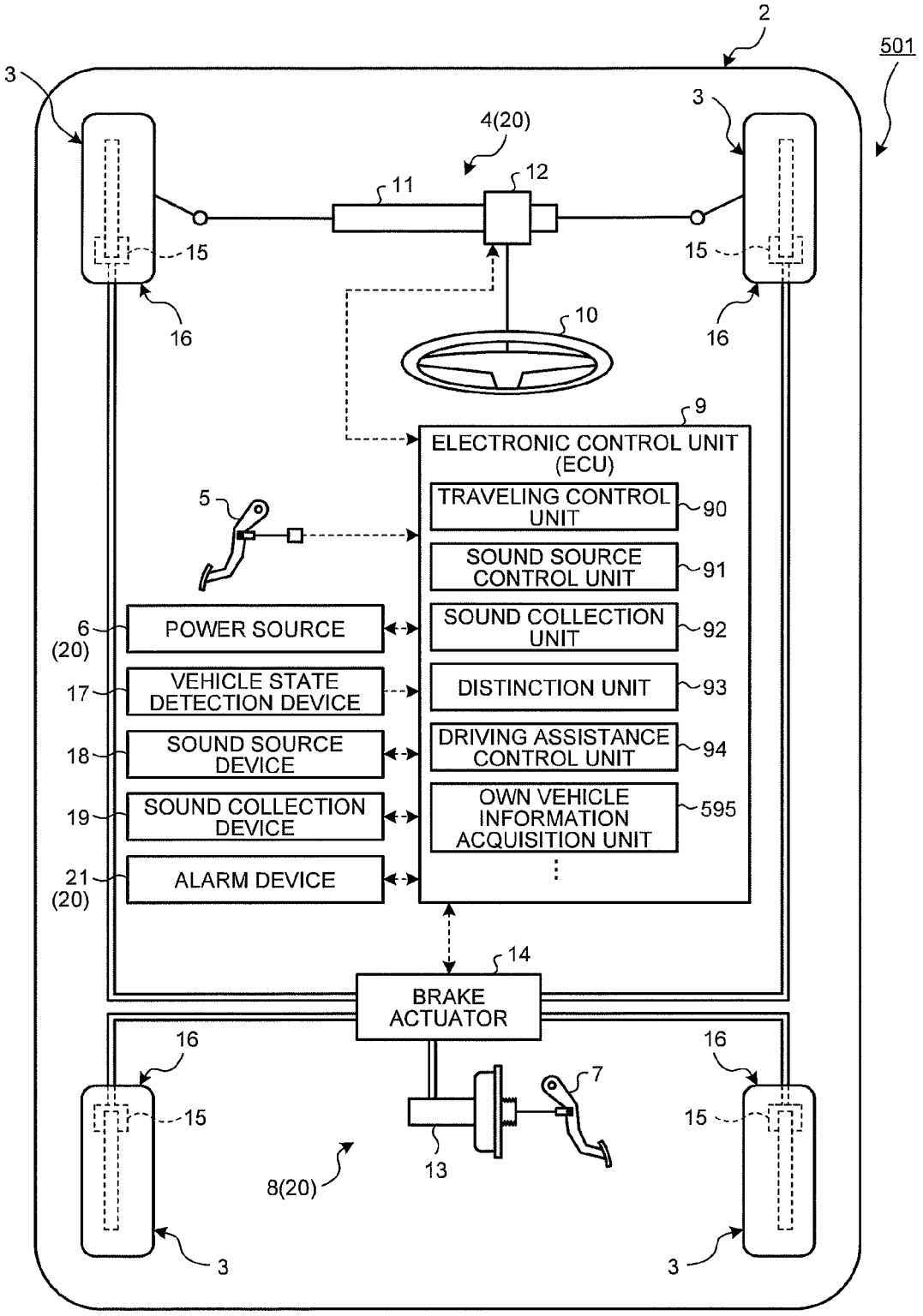
FIG. 15 is a schematic configuration diagram illustrating a vehicle that employs a driving assistance apparatus according to a fifth embodiment.
Figure 16:
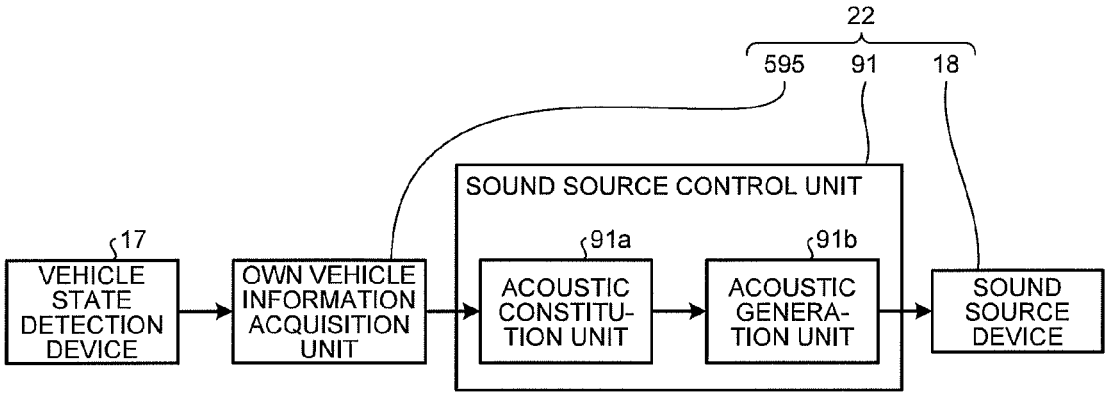
FIG. 16 is a flowchart illustrating a schematic configuration example of an acoustic generator of the driving assistance apparatus according to the fifth embodiment.
Figure 17:
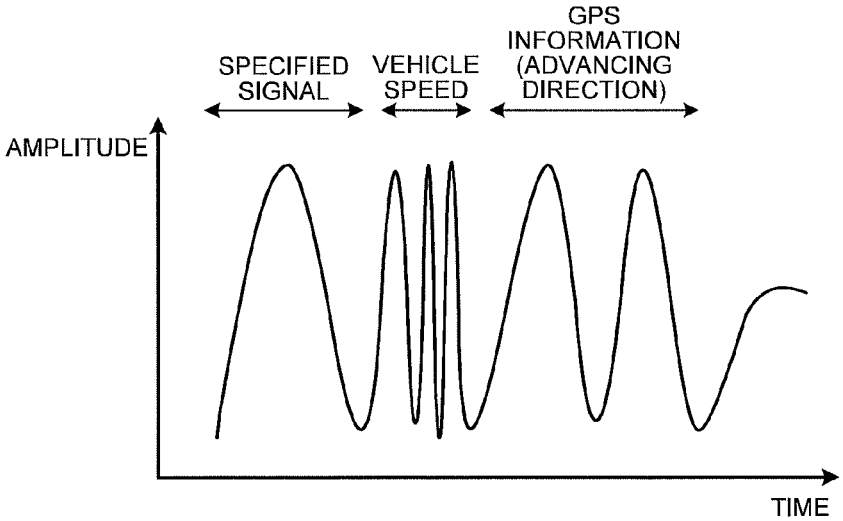
FIG. 17 is a line map illustrating an example of a waveform of a non-audible region sound which is generated by the acoustic generator of the driving assistance apparatus according to the fifth embodiment.
Figure 18:
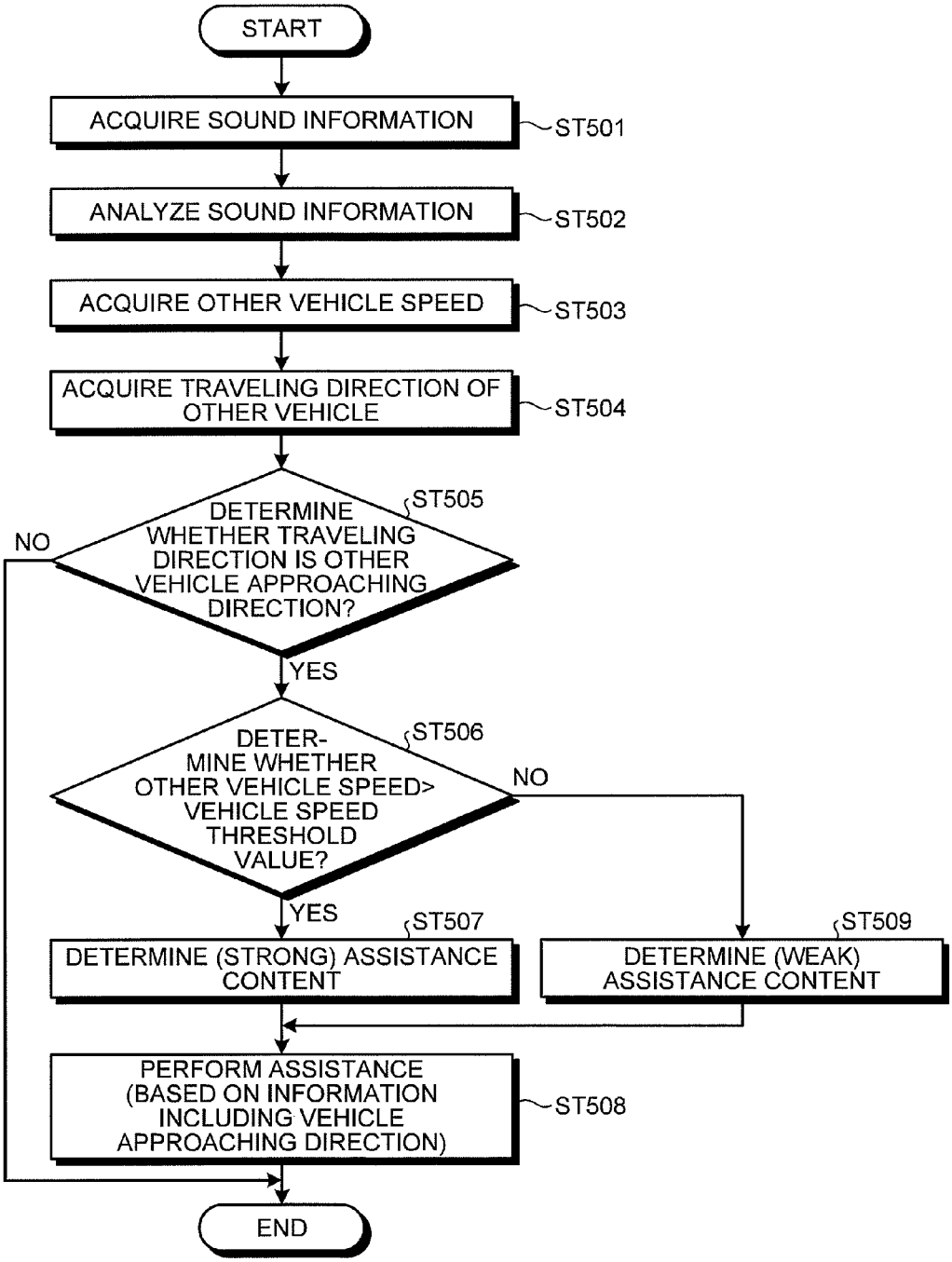
FIG. 18 is a flowchart illustrating an example of a control that is performed by an ECU of the driving assistance apparatus according to the fifth embodiment.

FIG. 15 is a schematic configuration diagram illustrating a vehicle that employs a driving assistance apparatus according to a fifth embodiment. FIG. 16 is a block diagram illustrating a schematic configuration example of an acoustic generator of the driving assistance apparatus according to the fifth embodiment. FIG. 17 is a line map illustrating an example of a waveform of the non-audible region sound which is generated by the acoustic generator of the driving assistance apparatus according to the fifth embodiment. FIG. 18 is a flowchart illustrating an example of a control that is performed by an ECU of the driving assistance apparatus according to the fifth embodiment. The driving assistance apparatus according to the fifth embodiment is different from those of the first, second, third, and fourth embodiments in that the sound source device outputs the non-audible region sound including information relating to the vehicle state.

A driving assistance apparatus 501 of the embodiment is configured to more specifically perform a driving assistance operation by the distinction at the vehicle collecting the non-audible region sound in that the sound source device 18 of each vehicle 2 outputs the non-audible region sound including information relating to the own vehicle state.

As illustrated in FIG. 15, the ECU 9 of the embodiment is equipped with an own vehicle information acquisition unit 595 in addition to the traveling control unit 90, the sound source control unit 91, the sound collection unit 92, the distinction unit 93, and the driving assistance control unit 94 from the concept of a function.

The own vehicle information acquisition unit 595 is an own vehicle information acquisition means that acquires information relating to the own vehicle state. The own vehicle information acquisition unit 595 acquires information relating to the state of the vehicle 2 detected by the vehicle state detection device 17.

FIG. 16 is a block diagram illustrating a schematic configuration example of the acoustic generator 22 of the embodiment. The acoustic generator 22 of the embodiment includes the own vehicle information acquisition unit 595 in addition to the sound source device 18 and the sound source control unit 91. Then, the sound source device 18 of the embodiment outputs a non-audible region sound which is a non-audible region sound of a predetermined frequency range set in advance and including information relating to the state of the vehicle 2 detected by the vehicle state detection device 17.

As an example, the own vehicle information acquisition unit 595 acquires information relating to the vehicle speed of the vehicle 2 detected by the vehicle speed sensor constituting the vehicle state detection device 17 and information relating to the traveling direction of the vehicle 2 based on the GPS information received by the GPS receiver, for example, as the information relating to the own vehicle state.

Then, the acoustic constitution unit 91*a* of the embodiment also serves as an own vehicle information conversion means that converts the information relating to the vehicle 2 detected by the vehicle state detection device 17 and acquired by the own vehicle information acquisition unit 595 into sound information of a non-audible region sound. The acoustic constitution unit 91*a* determines the waveform, the amplitude, the frequency, and the like as the acoustic characteristic of the non-audible region sound output from the sound source device 18. At this time, the acoustic constitution unit 91*a* sets the basic frequency of the non-audible region sound as a predetermined frequency within a frequency range corresponding to a non-audible region of a human or an animal as described above. Then, the acoustic constitution unit 91*a* sets the acoustic characteristic of the non-audible region sound output from the sound source device 18 as an acoustic characteristic in which the information relating to the vehicle speed and the information relating to the traveling direction based on the GPS information acquired by the own vehicle information acquisition unit 595 are buried as acoustic signals within a frequency range corresponding to the non-audible region.

FIG. 17 is an example of a waveform of the non-audible region sound to which the information relating to the vehicle speed and the information relating to the traveling direction based on the GPS information are applied by the acoustic constitution unit 91*a*. The non-audible region sound exemplified in FIG. 17 is a specified acoustic signal of a basic non-audible region sound, and the acoustic characteristic thereof is determined so as to obtain the acoustic signal of the non-audible region in accordance with the vehicle speed and the acoustic signal of the non-audible region in accordance with the traveling direction (the advancing direction) based on the GPS information. Furthermore, the acoustic signal arrangement pattern may be a predetermined existing arrangement pattern, and is not limited to this order. Then, the acoustic generation unit 91*b* controls the sound source device 18 based on the acoustic characteristic (the waveform, the amplitude, the frequency, and the like) which has the information relating to the vehicle 2 by the acoustic constitution unit 91*a* as described above, and outputs the non-audible region sound of the determined acoustic characteristic from the sound source device 18.

Then, the ECU 9 of the embodiment uses the information relating to the state of the vehicle 2 applied to the non-audible region sound as described above. The ECU 9 changes the driving assistance content of the assistance device 20 in the own vehicle in accordance with the information relating to the state of the vehicle 2 obtained by analyzing the sound information collected by the sound collection device 19 of the own vehicle.

The acoustic processing unit 92*b* of the embodiment also serves as a sound information analysis means that acquires the information relating to the other vehicle state by analyzing the sound information collected by the sound collection device 19 of the own vehicle. The acoustic processing unit 92*b* separates the information relating to the other vehicle applied to the non-audible region sound by the acoustic constitution unit 91*a* as described above by analyzing the sound information collected by the sound collection device 19 and acquired by the acoustic acquisition unit 92*a*. Here, the acoustic processing unit 92*b* extracts the information relating to the traveling direction based on the GPS information and the information relating to the vehicle speed from the non-audible region sound included in the sound information by analyzing the sound information collected by the sound collection device 19 of the own vehicle.

Then, the assistance determination unit 93*b* changes the driving assistance content of the assistance device 20 in the own vehicle based on the information relating to the other vehicle state, the information relating to the traveling direction based on the GPS information, and the information relating to the vehicle speed analyzed by the acoustic processing unit 92*b* as described above. The assistance determination unit 93*b* determines the assistance content so that a relatively strong driving assistance operation is performed, for example, when the acquired other vehicle speed is a relatively large value, that is, the approaching vehicle moves close to the own vehicle at the relatively fast speed. Meanwhile, the assistance determination unit 93*b* determines the assistance content so that a relatively weak driving assistance operation is performed, for example, when the acquired other vehicle speed is a relatively small value, that is, the approaching vehicle moves close to the own vehicle at the relatively slow speed. Further, the assistance determination unit 93*b* may determine the assistance content so that the driving assistance operation is performed in accordance with, for example, the acquired traveling direction of the other vehicle. In this case, the assistance determination unit 93*b* may determine the assistance content so that the driving assistance operation is performed by using the information relating to the vehicle approaching direction, for example, when the driver is awakened.

Next, an example of a control that is performed by the ECU 9 will be described with reference to the flowchart of FIG. 18.

First, the acoustic acquisition unit 92*a* acquires the sound information around the own vehicle collected by the sound collection device 19 (step ST501).

Next, the acoustic processing unit 92*b* analyzes the content of the sound information acquired by the acoustic acquisition unit 92*a* in step ST501 (step ST502). The acoustic processing unit 92*b* separates the information relating to the other vehicle applied to the non-audible region sound by analyzing the sound information acquired by the acoustic acquisition unit 92*a*.

Next, the acoustic processing unit 92*b* acquires the other vehicle speed based on the information relating to the other vehicle analyzed by the acoustic processing unit 92*b* in step ST502 (step ST503).

Next, the acoustic processing unit 92*b* acquires the traveling direction of the other vehicle based on the information relating to the other vehicle analyzed by the acoustic processing unit 92*b* in step ST502 (step ST504).

Next, the assistance target determination unit 93*a* determines whether the traveling direction of the other vehicle is the approaching direction with respect to the own vehicle based on the traveling direction of the other vehicle acquired by the acoustic processing unit 92*b* in step ST504 (step ST505). When the assistance target determination unit 93*a* determines that the traveling direction of the other vehicle is not the approaching direction with respect to the own vehicle or the non-audible region sound from the other vehicle is not collected in step ST505 (step ST505: No), the ECU 9 ends the current control period and selects the next control period.

When the assistance target determination unit 93*a* determines that the traveling direction of the other vehicle is the approaching direction with respect to the own vehicle in step ST505 (step ST505: Yes), the assistance determination unit 93*b* determines whether the other vehicle speed acquired by the acoustic processing unit 92*b* in step ST503 is larger than a vehicle speed threshold value set in advance (step ST506). Here, the vehicle speed threshold value may be set in advance based on the approaching speed of the other vehicle that needs a relatively strong driving assistance operation.

When the assistance determination unit 93*b* determines that the other vehicle speed is larger than the vehicle speed threshold value in step ST506 (step ST506: Yes), the assistance determination unit 93*b* determines the assistance content so that a relatively strong driving assistance operation is performed (step ST507).

Next, the assistance execution unit 94*a* performs the driving assistance operation according to the content determined by the assistance determination unit 93*b* by controlling the assistance device 20 based on the assistance content determined by the assistance determination unit 93*b* in step ST507 (step ST508). Then, the current control period ends, and the next control period is selected.

When the assistance determination unit 93*b* determines that the other vehicle speed is the vehicle speed threshold value or less in step ST506 (step ST506: No), the assistance determination unit 93*b* determines the assistance content so that a relatively weak driving assistance operation is performed (step ST509).

Next, the assistance execution unit 94*a* performs the driving assistance operation according to the content determined by the assistance determination unit 93*b* by controlling the assistance device 20 based on the assistance content determined by the assistance determination unit 93*b* in step ST509 (step ST508). Then, the current control period ends, and the next control period is selected.

Furthermore, in step ST507 and step ST509, the assistance determination unit 93*b* may determine the assistance content so that the driving assistance operation is performed by using, for example, the information on the vehicle approaching direction. Then, in step ST509, the assistance execution unit 94*a* may control the assistance device 20 so that the driving assistance operation is performed by using the information on the vehicle approaching direction.

The driving assistance apparatus 501 of the above-described embodiment actively and mutually generates the non-audible region sound in the plurality of vehicles 2 and notifies the existence of the own vehicle to the other vehicle by using the non-audible region sound, so that the other vehicle around the own vehicle may be determined. As a result, the driving assistance apparatus 501 may appropriately distinguish and handle the other vehicle.

Further, according to the driving assistance apparatus 501 of the above-described embodiment, the driving assistance apparatus includes the vehicle state detection device 17 which detects the vehicle state, and the sound source device 18 outputs a non-audible region sound which is a non-audible region sound of a predetermined frequency range and includes the information relating to the state of the vehicle 2 detected by the vehicle state detection device 17. Then, the ECU 9 changes the driving assistance content of the assistance device 20 in the own vehicle in accordance with the information relating to the other vehicle obtained by analyzing the sound information collected by the sound collection device 19 of the own vehicle.

Thus, since the sound source device 18 outputs the non-audible region sound including the information relating to the state of the vehicle 2, the driving assistance apparatus 501 may more specifically recognize the other vehicle state at the vehicle collecting the non-audible region sound. Accordingly, it is possible to more specifically distinguish the other vehicle and to reduce the load at the vehicle collecting the sound. Accordingly, the driving assistance apparatus 501 of the own vehicle may more appropriately assist the driving operation in accordance with the other vehicle state. Further, since the assistance content is determined based on the other vehicle speed, the traveling direction, and the like as the other vehicle information, the driving assistance apparatus 501 may assist the driving operation in accordance with the other vehicle state without giving a discomfort to the driver.

Furthermore, it is described that the above-described driving assistance apparatus 501 uses the information relating to the traveling direction based on the GPS information and the information relating to the vehicle speed as the information relating to the vehicle state, but the invention is not limited thereto. The driving assistance apparatus 501 may use the information relating to the other vehicle state detected by the vehicle state detection device 17 as the information relating to the vehicle state.

Furthermore, the other-vehicle detection apparatus, the driving assistance apparatus, and the other-vehicle detection method according to the above-described embodiments of the invention are not limited to those of the above-described embodiments, and various modifications may be made within the scope of claims. The driving assistance apparatus according to the embodiment may be configured by the appropriate combination of the components of the above-described embodiments.

The above-described driving assistance apparatus may not include the assistance device and may serve as only the other-vehicle detection apparatus.

In the description above, it is described that the alarm device outputs visual information and auditory information as the alarm information, but the invention is not limited thereto. For example, the alarm device may include a haptic information output device that outputs haptic information such as a handle vibration, a seat vibration, and a pedal reaction force as alarm information.

REFERENCE SIGNS LIST

1, 201, 301, 401, 501 DRIVING ASSISTANCE APPARATUS (OTHER-VEHICLE DETECTION APPARATUS)
2 VEHICLE
4 STEERING DEVICE
6 POWER SOURCE
8 BRAKING DEVICE
9 ECU (DISTINCTION DEVICE, CONTROL DEVICE)
17 VEHICLE STATE DETECTION DEVICE
18 SOUND SOURCE DEVICE
19 SOUND COLLECTION DEVICE
20 ASSISTANCE DEVICE
21 ALARM DEVICE
22 ACOUSTIC GENERATOR
23 ACOUSTIC RECEIVER
90 TRAVELING CONTROL UNIT
91 SOUND SOURCE CONTROL UNIT
91*a* ACOUSTIC CONSTITUTION UNIT
91*b* ACOUSTIC GENERATION UNIT
92 SOUND COLLECTION UNIT
92*a* ACOUSTIC ACQUISITION UNIT
92*b* ACOUSTIC PROCESSING UNIT
93 DISTINCTION UNIT
93*a* ASSISTANCE TARGET DETERMINATION UNIT
93*b* ASSISTANCE DETERMINATION UNIT
94 DRIVING ASSISTANCE CONTROL UNIT
94*a* ASSISTANCE EXECUTION UNIT
595 OWN VEHICLE INFORMATION ACQUISITION UNIT

The invention claimed is:

1. An other-vehicle detection apparatus comprising:
a sound source device mounted on a first vehicle and configured to output a non-audible region sound of a predetermined frequency range set in advance;
a sound collection device mounted on the first vehicle and configured to collect sound information around the first vehicle; and
a distinction device configured to distinguish a second vehicle based on a non-audible region sound included in the sound information collected by the sound collection device of the first vehicle,
wherein the distinction device distinguishes the second vehicle approaching the first vehicle based on a difference between a frequency of the non-audible region sound included in the sound information collected by the sound collection device of the first vehicle and a frequency of a non-audible region sound output from a sound source device of the second vehicle.

2. An other-vehicle detection apparatus comprising:
a sound source device mounted on a first vehicle and configured to output a non-audible region sound of a predetermined frequency range set in advance;
a sound collection device mounted on the first vehicle and configured to collect sound information around the first vehicle; and
a distinction device configured to distinguish a second vehicle based on a non-audible region sound included in the sound information collected by the sound collection device of the first vehicle,
wherein at a time a frequency of the non-audible region sound output from the sound source device of the first vehicle is same as a frequency of a non-audible region sound output from a sound source device of the second vehicle, the distinction device distinguishes between the first vehicle and the second vehicle, which is traveling, based on a difference between the frequency of the non-audible region sound included in the sound information collected by the sound collection device of the first vehicle and the frequencies of the non-audible region sounds output from the sound source devices of the first vehicle and the second vehicle.

3. An other-vehicle detection apparatus comprising:
a sound source device mounted on a first vehicle and configured to output a non-audible region sound of a predetermined frequency range set in advance;
a sound collection device mounted on the first vehicle and configured to collect sound information around the first vehicle;
a distinction device configured to distinguish a second vehicle based on a non-audible region sound included in the sound information collected by the sound collection device of the first vehicle; and
a vehicle state detection device configured to detect a state of the first vehicle,
wherein the sound source device outputs a non-audible region sound including information relating to the state of the first vehicle detected by the vehicle state detection device and corresponding to the non-audible region sound of the predetermined frequency range.

4. A driving assistance apparatus comprising:
a sound source device mounted on a first vehicle and configured to output a non-audible region sound of a predetermined frequency range set in advance;
a sound collection device mounted on the first vehicle and configured to collect sound information around the first vehicle;
a distinction device configured to distinguish a second vehicle based on a non-audible region sound included in the sound information collected by the sound collection device of the first vehicle;
an assistance device mounted on the first vehicle and configured to assist a driving operation in the first vehicle; and
a control device configured to assist the driving operation by controlling the assistance device of the first vehicle at a time the distinction device distinguishes the second vehicle,
wherein the control device calculates a vehicle speed of the second vehicle based on a difference between a frequency of the non-audible region sound included in the sound information collected by the sound collection device of the first vehicle and a frequency of the non-audible region sound output from a sound source device of the second vehicle as the information relating to the second vehicle, and changes a driving assistance content of the assistance device in the first vehicle based on the calculated vehicle speed of the second vehicle.

5. A driving assistance apparatus comprising:

a sound source device mounted on a first vehicle and configured to output a non-audible region sound of a predetermined frequency range set in advance;

a sound collection device mounted on the first vehicle and configured to collect sound information around the first vehicle;

a distinction device configured to distinguish a second vehicle based on a non-audible region sound included in the sound information collected by the sound collection device of the first vehicle;

an assistance device mounted on the first vehicle and configured to assist a driving operation in the first vehicle;

a control device configured to assist the driving operation by controlling the assistance device of the first vehicle at a time the distinction device distinguishes the second vehicle; and a vehicle state detection device configured to detect a state of the first vehicle, wherein the sound source device outputs a non-audible region sound including information relating to the state of the first vehicle detected by the vehicle state detection device and corresponding to the non-audible region sound of the predetermined frequency range, and wherein the control device changes a driving assistance content of the assistance device in the first vehicle in accordance with information relating to a state of the second vehicle obtained by analyzing the sound information collected by the sound collection device of the first vehicle.

6. An other-vehicle detection method comprising:

outputting a non-audible region sound of a predetermined frequency range set in advance, by using a sound source device mounted on a first vehicle;

collecting sound information around the first vehicle, using a sound collection device mounted on the first vehicle; and distinguishing, using a distinction device, a second vehicle based on a non-audible region sound included in the sound information collected by the sound collection device of the first vehicle, wherein the distinction device distinguishes the second vehicle approaching the first vehicle based on a difference between a frequency of the non-audible region sound included in the sound information collected by the sound collection device of the first vehicle and a frequency of a non-audible region sound output from a sound source device of the second vehicle.

* * * * *